US010450739B1

(12) United States Patent
Schlagel

(10) Patent No.: US 10,450,739 B1
(45) Date of Patent: Oct. 22, 2019

(54) TEMPORARY OR SEMI-PERMANENT STRUCTURE AND METHOD OF INCREASING USABLE SPACE

(71) Applicant: OB DEVELOPMENT LLC, Kansas City, MO (US)

(72) Inventor: Aaron Schlagel, Kansas City, MO (US)

(73) Assignee: OB DEVELOPMENT LLC, Kansas City, MO (US)

( * ) Notice: Subject to any disclaimer, the term of this patent is extended or adjusted under 35 U.S.C. 154(b) by 0 days.

(21) Appl. No.: 15/938,041

(22) Filed: Mar. 28, 2018

Related U.S. Application Data

(60) Provisional application No. 62/571,885, filed on Oct. 13, 2017.

(51) Int. Cl.
*E04H 1/12* (2006.01)
*E04B 1/343* (2006.01)
(Continued)

(52) U.S. Cl.
CPC ..... *E04B 1/34352* (2013.01); *E04B 1/18* (2013.01); *E04B 1/34807* (2013.01);
(Continued)

(58) Field of Classification Search
CPC ..... E04H 1/1205; E04H 1/005; E04B 1/343; E04B 1/348; E04B 1/34815;
(Continued)

(56) References Cited

U.S. PATENT DOCUMENTS 3,245,183 A * 4/1966 Tessin, II ..... E04B 1/14 52/243
4,006,566 A * 2/1977 Forgiarini ..... E04B 1/34315 52/220.2

(Continued)

FOREIGN PATENT DOCUMENTS

CN 106381928 2/2017
CN 107090989 8/2017

(Continued)

OTHER PUBLICATIONS

ZEDpod—A Prefab Design that Transforms Car Parks into Housing Developments, http://www.humble-homes.com/zedpod-a-prefab-design-that-transforms-car-parks-into-housingdevelopments/, Apr. 28, 2016.

(Continued)

*Primary Examiner* — Gisele D Ford
(74) *Attorney, Agent, or Firm* — Stinson LLP

(57) ABSTRACT

A structure with a support assembly having an upper surface spaced above a lower surface, a module removably supported by the upper surface of the support assembly, and an access system that is configured to allow a person adjacent the lower surface of the support assembly to move vertically upward adjacent the upper surface of the support assembly. The module at least partially encloses an interior space that is accessible through an opening in the module. The module is not permanently joined to the support assembly, and there is an accessible volume of space positioned below the module. The access system is positioned in a corner of a parking lot, the module extends laterally outward from the access system, and the module is positioned above at least one parking space in the parking lot.

13 Claims, 33 Drawing Sheets

(51) Int. Cl.

| | |
|---|---|
| ***E04B 1/348*** | (2006.01) |
| ***E04H 6/02*** | (2006.01) |
| ***E04B 1/18*** | (2006.01) |
| ***E04F 11/02*** | (2006.01) |
| *E04H 1/06* | (2006.01) |
| *E04H 1/02* | (2006.01) |

(52) U.S. Cl.
CPC ..... *E04F 11/02* (2013.01); *E04H 6/02* (2013.01); *E04H 1/02* (2013.01); *E04H 1/06* (2013.01)

(58) Field of Classification Search
CPC ..... E04B 1/34315; E04B 2001/34389; E04B 1/3483; E04B 1/34331; E04B 2001/34892
See application file for complete search history.

(56) References Cited

U.S. PATENT DOCUMENTS

| | | | | |
|---|---|---|---|---|
| 4,513,545 | A * | 4/1985 | Hopkins, Jr. | E04B 1/348 52/745.03 |
| 4,930,273 | A | 6/1990 | Papesch | |
| 5,381,633 | A * | 1/1995 | Hendrich | E04B 1/344 52/235 |
| 5,402,608 | A | 4/1995 | Chu | |
| 5,491,934 | A * | 2/1996 | Bigelow, Jr. | E04B 1/34321 52/143 |
| 5,575,120 | A * | 11/1996 | Handley | A47B 87/007 446/124 |
| 6,925,761 | B1 * | 8/2005 | De La Marche | E04B 1/34815 52/220.1 |
| 8,186,109 | B2 * | 5/2012 | Warminsky | E04H 9/10 52/745.02 |
| 8,341,902 | B2 | 1/2013 | Kusuma | |
| 9,347,233 | B2 * | 5/2016 | Rogers | E04B 1/343 |
| 9,617,748 | B2 | 4/2017 | Wilson et al. | |
| D829,925 | S | 10/2018 | Labesque et al. | |
| 2003/0213188 | A1 * | 11/2003 | Bigelow | E04B 1/34321 52/174 |
| 2004/0107651 | A1 * | 6/2004 | Johnson | E04B 1/3483 52/6 |
| 2005/0262778 | A1 * | 12/2005 | Allen | E04B 1/34815 52/79.1 |
| 2005/0279035 | A1 * | 12/2005 | Donovan | E04B 1/348 52/79.1 |
| 2008/0276553 | A1 * | 11/2008 | Ingjaldsdottir | E04B 1/3483 52/184 |
| 2009/0031642 | A1 * | 2/2009 | Donovan | E04B 1/3444 52/79.1 |
| 2011/0056147 | A1 * | 3/2011 | Beaudet | E04B 1/3483 52/79.9 |
| 2013/0239487 | A1 * | 9/2013 | Ingjaldsdottir | E04C 2/384 52/79.1 |
| 2013/0305629 | A1 * | 11/2013 | Stephenson | E04B 1/3483 52/79.9 |
| 2018/0194442 | A1 * | 7/2018 | Loudrup | B63B 35/44 |

FOREIGN PATENT DOCUMENTS

| | | |
|---|---|---|
| GB | 1441966 | 7/1976 |
| JP | 2002194814 | 7/2002 |
| JP | 2000110242 | 1/2003 |
| JP | 2013133624 | 7/2013 |
| WO | WO 2017145137 | 8/2017 |

OTHER PUBLICATIONS

New firm offers snap-together homes above car parks, http://www.bimplus.co.uk/technologies/new-firm-offers-sn2ap-toge7ther-ho8mes-car-park/, Dec. 1, 2016.

* cited by examiner

TEMPORARY OR SEMI-PERMANENT STRUCTURE AND METHOD OF INCREASING USABLE SPACE

CROSS-REFERENCE TO RELATED APPLICATIONS

This application is based on and claims priority to U.S. Provisional Application Ser. No. 62/571,885, filed on Oct. 13, 2017, which is incorporated herein by reference in its entirety.

STATEMENT REGARDING FEDERALLY SPONSORED RESEARCH OR DEVELOPMENT

Not applicable.

STATEMENT REGARDING JOINT RESEARCH AGREEMENT

Not applicable.

BACKGROUND OF THE INVENTION

1. Field of the Invention

The invention relates to a temporary or semi-permanent structure and, in particular, to a temporary or semi-permanent structure that may be installed on a site to increase the amount of usable space at the site without eliminating or significantly detracting from the site's current or future permanent usage.

2. Description of Related Art

Land owners may acquire land that is undeveloped or partially developed and hold it for a number of years, or even decades, before the land is fully developed. In urban areas, undeveloped or partially developed land is often used as surface parking for nearby buildings and residences. In suburban areas, surface parking is used for retail, restaurant, and other uses where the parking needs fluctuate or change over time. While using land as surface parking provides income for the land owner prior to full development of the site (or serves another use, e.g., retail, restaurant, office, hotel, apartments, etc.), it does not necessarily maximize income generation at the site during the time period before the site is fully developed or in cases where the need for parking is in seasonal demand or subject to other market cycle demand fluctuations. Surface parking lots also typically include space that is un-utilized or underutilized due to the configuration of the parking spaces within the lot. For example, corner sections of the parking lot or center islands of the parking lot are not available to be used for parking. Further, there is a need in many urban areas, and suburban areas, for relatively low cost, flexible space that may be used for a variety of purposes, including as an apartment, temporary lodging, retail, restaurant, storage, and/or office.

BRIEF SUMMARY OF THE INVENTION

A structure in accordance with one embodiment of the invention described herein includes a support assembly, a module removably supported by an upper surface of the support assembly, and an access system that is configured to allow a person adjacent a lower surface of the support assembly to move vertically upward adjacent the upper surface of the support assembly. The module at least partially encloses an interior space that is accessible through an opening in the module. The module is not permanently joined to the support assembly, and there is an accessible volume of space positioned below the module. Preferably, the structure is installed at a site that allows the land owner to make additional income at the site, by renting or selling the space within the module, without losing any potential income from the site's current use. The accessible volume of space below the module may be used for any purpose, including the pre-existing usage of the space at the site where the structure is located. For example, if the structure is located in a parking lot, the module may be positioned above parking spaces in the lot that may continue to be used for parking automobiles. Further, because the module is removably supported by the support assembly and is not permanently joined to the support assembly, the module, and other components of the structure, preferably may be moved for reuse at a different site if it is desired to develop the original site with a permanent higher-income producing structure. The structure, in accordance with the invention, may be installed at any type of site, including, but not limited to, a parking lot, vacant land, or on the roof of an existing structure.

Preferably, the interior space within the module is habitable space that may be used as an apartment or temporary lodging room, storage space, space configured for use as an office or retail store, a restaurant, or any combination of the foregoing. The access system may comprise stairs, an elevator, and/or a ladder. Preferably, the access system is located on un-utilized or underutilized space so that it does not eliminate or significantly detract from the existing usage of the space (e.g., the access system may be located in the corner of a parking lot or in a center island of a parking lot in space where it does not eliminate any of the parking spaces within the parking lot). The access system may also be located within a parking stall(s) at the determination of the land owner. The structure may include any number of modules that are either supported directly by the upper surface of the support assembly or by another module. For example, the structure may include a second module that is supported by the support assembly and third and fourth modules that are positioned on top of, and supported by, first and second modules, respectively. Preferably, a walkway may also be utilized to connect two or more modules along the structure's exterior or interior on either or both sides to provide access between horizontally placed modules.

In one preferred embodiment, the access system is installed in the corner of an existing parking lot where it does not eliminate any of the parking spaces within the parking lot, and the support assembly includes columns, which are positioned between parking spaces in the parking lot so that the support assembly does not eliminate any of the parking spaces. The first and second modules each extend laterally outward from the access system and are positioned above at least one parking space in the parking lot. The first and second modules are generally perpendicular to each other with the access system positioned adjacent an end of each module.

The module preferably includes utility connections that are operable to be releasably connected with utilities that are available at the site, or brought to the site through other means, where the structure is installed. For example, the module may include an electrical connection, gas connection, potable water connection, and sewer connection. If a second module is placed on top of the module, the module also preferably includes inter-module utility connections that are operable to be releasably connected with the utility connections of the second module to provide the second module with access to the utilities available at the site. Alternatively, or in addition to the foregoing, the module may include structure or apparatuses designed to provide a replacement utility service to the module (e.g., electrical generator, solar panels, potable water storage reservoir, gas storage reservoir, and sewage reservoir).

A method of increasing usable space in accordance with the invention described herein includes the step of installing a structure having a support assembly, module, and access system as described above. To install the structure, the support assembly and access system are preferably first erected at the site where it is desired to increase usable space. The support assembly and access system are preferably coupled to the ground in a removable manner so they may be moved and reused at a different site in the future. The module is then preferably lifted and placed on top of the support assembly. The module may be lifted and placed on top of the support assembly in one piece or in multiple sections that are each individually lifted and placed on the support assembly. The module is removably joined to the support assembly in a manner that may be reversed if it is desired to uninstall the structure from the site in the future. Additional modules may be removably placed on top of the support assembly, and/or on top of modules already in place.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1A:
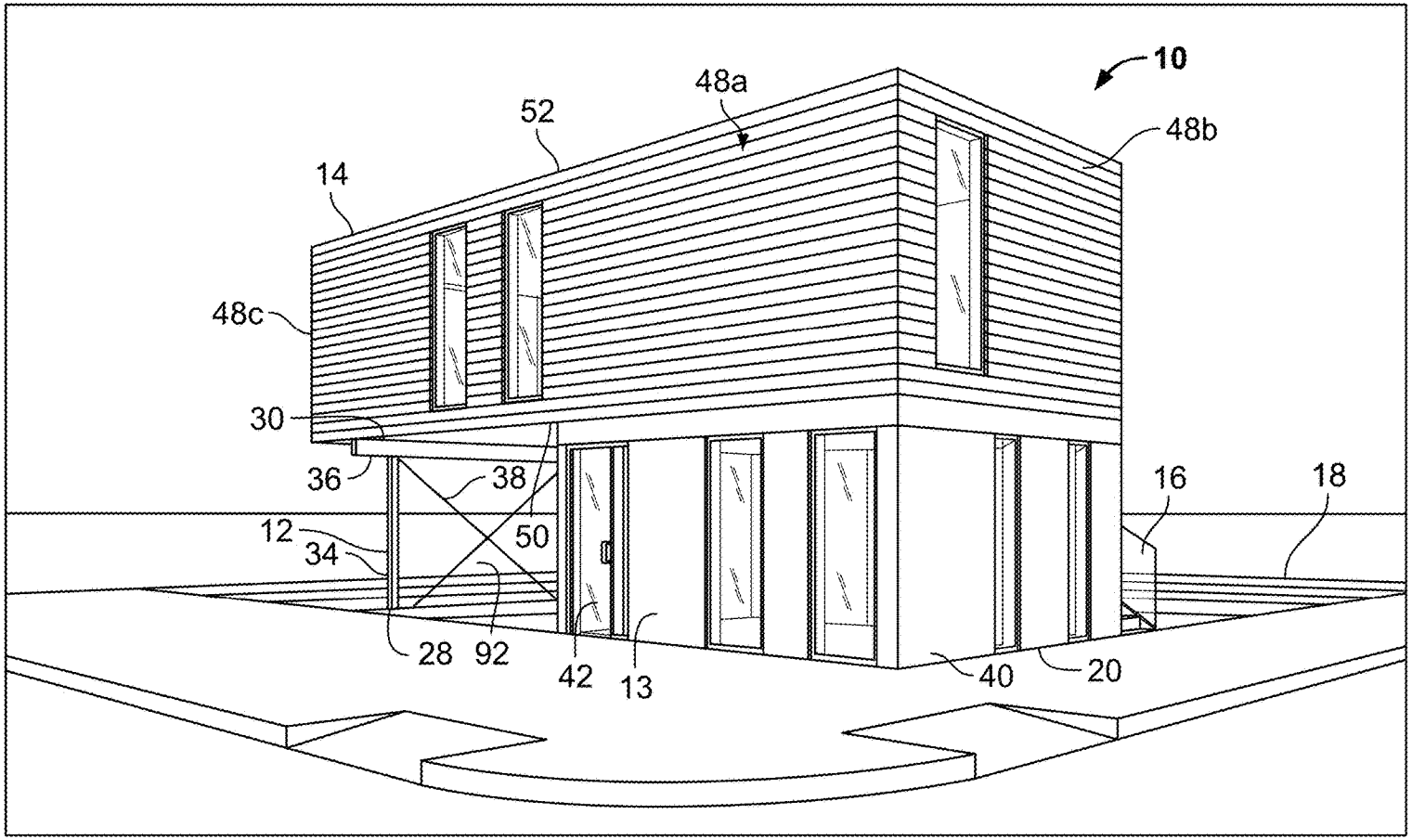
FIGS. 1A-1C show perspective views of a first exemplary embodiment of structure in accordance with the invention described herein.
Figure 1B:
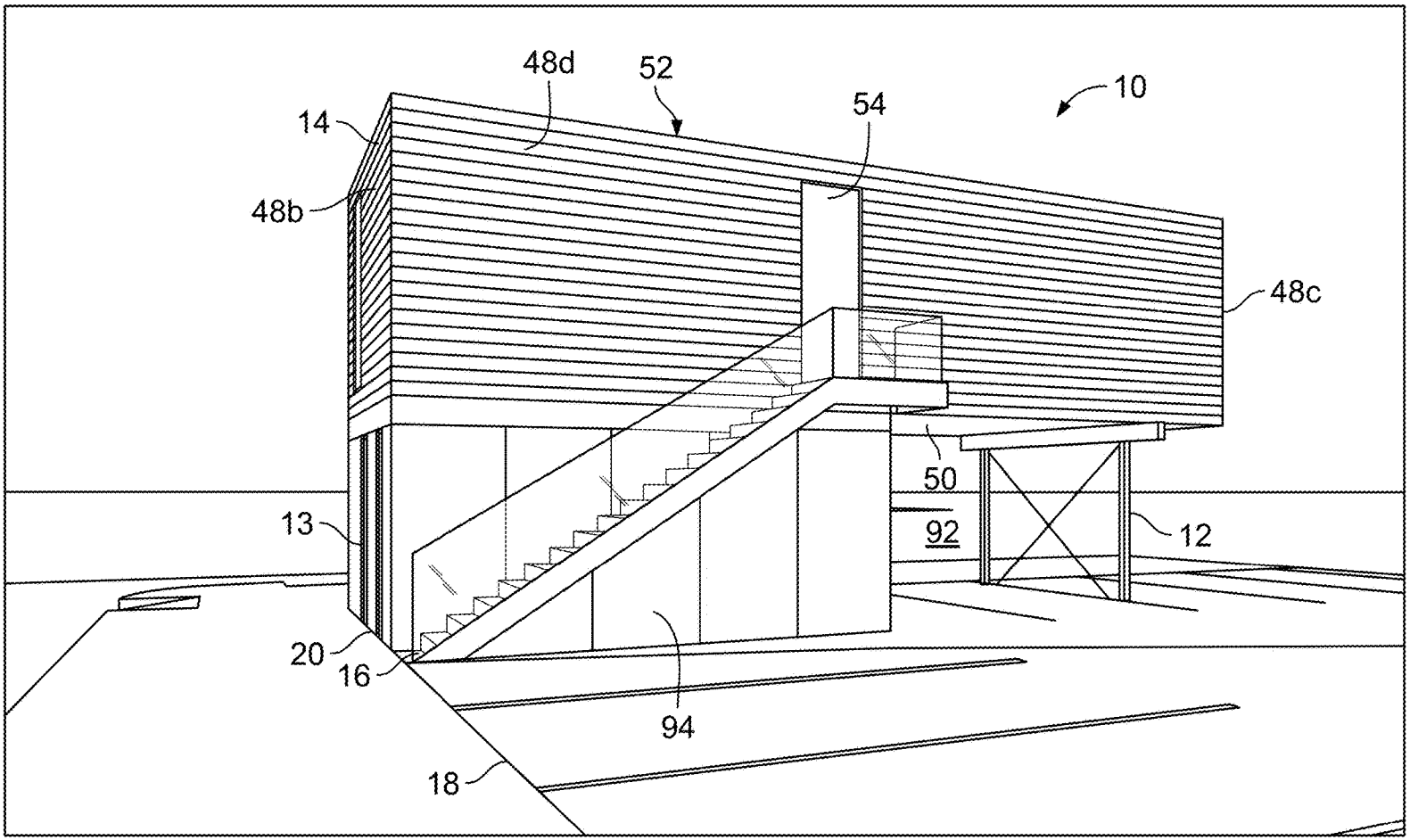
Figure 1C:
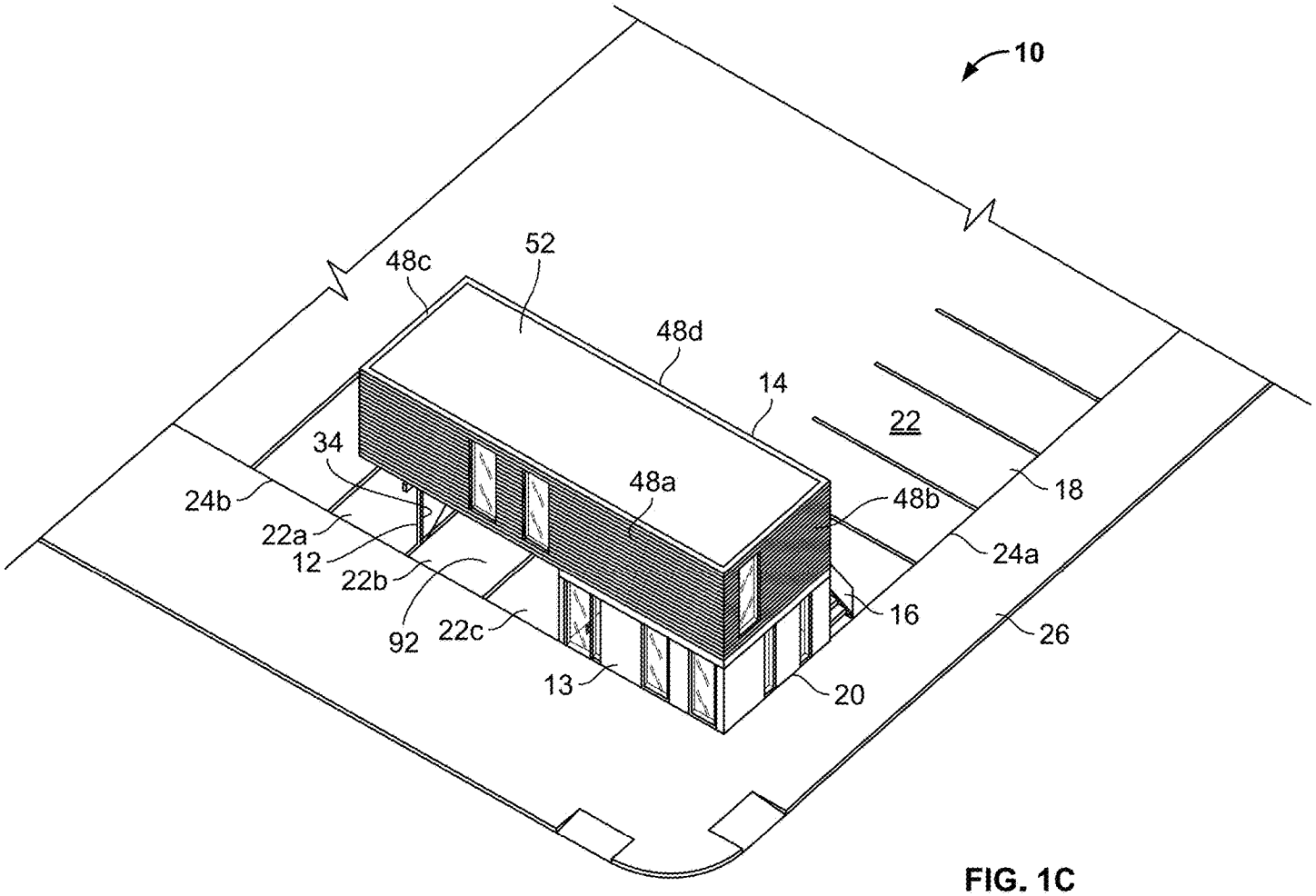

A structure in accordance with one exemplary embodiment of the invention described herein is identified generally as 10 in FIGS. 1A-1C. Structure 10 is preferably semi-permanent or temporary such that it can be installed and removed with relative ease in the event that the land or other area on which structure 10 is positioned is needed or desired to be used for another purpose (e.g., development of a high-rise office/apartment building/hotel or other structure on a parking lot on which structure 10 is positioned). Preferably, structure 10 is used in a temporary or semi-permanent manner on a site in a manner that allows current usage of the site to continue before such permanent structure is considered. For example, structure 10 is preferably removable for use at a different site allowing for future development opportunities of greater density at the original site.

Structure 10 includes a support assembly 12, a ground-level enclosure 13, a module 14, and an access system 16 (best shown in FIG. 1B). FIGS. 1A-1C show structure 10 located in a parking lot 18, which may be any type of parking lot (e.g., an urban area parking lot, a retail parking lot, a restaurant parking lot, an office parking lot, an airport parking lot, or a car rental agency parking lot). Specifically, ground-level enclosure 13 and access system 16 are located in a corner section 20 of the parking lot 18 in an area that is conventionally un-utilized or underutilized due to the configuration of the parking spaces 22 located in the parking lot 18. Ground-level enclosure 13 and access system 16 may also be located partially or entirely within one or more parking spaces 22. Referring to FIG. 1C, parking lot 18 includes a plurality of parking spaces 22 that are each oriented perpendicular to peripheral boundary lines 24*a-b* between the parking lot 18 and a sidewalk 26, or other piece of land, adjacent to the parking lot 18. Corner section 20 is un-utilized or underutilized space of parking lot 18 because it cannot be easily used to park an automobile due to the configuration of parking spaces 22 (i.e., if automobiles are parked in the parking spaces 22 adjacent to corner section 20, an automobile within parking lot 18 cannot access corner section 20). Ground-level enclosure 13 and access system 16 are located within corner section 20 so that they do not eliminate any of the parking spaces 22 within parking lot 18. In this manner, structure 10 increases the amount of usable space within parking lot 18, by providing a ground-level enclosure 13 and a module 14, which may be used for a variety of purposes discussed herein, without eliminating or significantly detracting from the existing usage of parking lot 18 (i.e., structure 10 does not eliminate any of the existing parking spaces 22 within parking lot 18).

While FIGS. 1A-1C show structure 10 positioned in the corner of a parking lot 18, it is within the scope of the invention for structure 10 to be positioned in alternative locations. For example, structure 10 may be positioned with ground-level enclosure 13 and access system 16 in the island of a parking lot, on vacant land, or on the roof of a building or other structure, such as a multi-level parking structure. Preferably, ground-level enclosure 13 and access system 16 are located in an area of un-utilized or underutilized space so that they do not eliminate or detract from the existing usage of the space. Preferably, module 14 is at least partially positioned above a volume of space that may be used for any desired purpose, such as the parking of automobiles, storage, retail, a restaurant(s), and/or the location of HVAC components.

Support assembly 12 supports and elevates module 14 above the ground level of parking lot 18. Support assembly 12 includes a lower surface 28 that is supported by the ground and an upper surface 30, which is spaced above lower surface 28 and supports module 14. Support assembly 12 includes a plurality of columns 34, beams 36, and cross-braces 38 that are suitably designed, constructed, and installed to support module 14. Support assembly 12 may consist of a plurality of discrete, unconnected components or subassemblies that cooperate to support module 14 above the ground level of parking lot 18, or support assembly 12 may consist of an integrated, connected assembly of components that support module 14. Portions of support assembly 12 are hidden from view in FIGS. 1A-1C by the walls of ground-level enclosure 13. Preferably, support assembly 12 includes additional columns, beams, and/or cross-braces located within, integrated into, or adjacent to the walls of ground-level enclosure 13. In the example shown in FIGS. 1A-1C, the walls of ground-level enclosure 13 themselves may also form a portion of support assembly 12 that operates to support module 14 above the ground. While FIGS. 1A-1C show lower surface 28 supported by the ground, it is also within the scope of the invention for lower surface 28 to be supported by an existing structure, such as a building roof or floor of a multi-level parking structure, or a footing and/or foundation system that can be removed once the structure 10 is removed. Support assembly 12 may be constructed from modular components that are releasably connected to each other so that it is relatively easy to deconstruct support assembly 12 and remove it from the site on which it is installed.

Figure 1D:
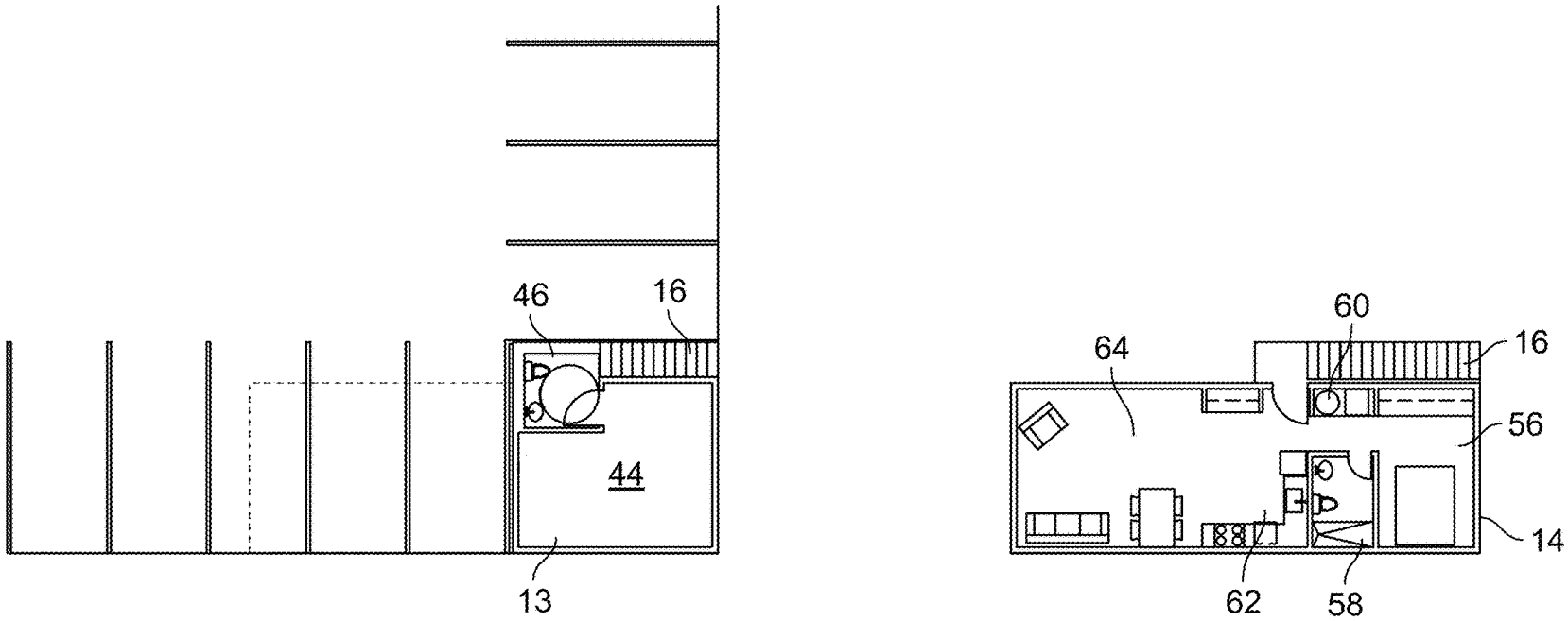
FIG. 1D shows plan views of an exemplary floor layout for the structure shown in FIGS. 1A-1C.

Ground-level enclosure 13 is supported by support assembly 12 and the ground beneath a portion of module 14. Ground-level enclosure 13 includes four walls 40 that enclose an interior space, which may be used for any desired purpose, such as an apartment, a lodging room, a retail store, storage, restaurant, or an office. A door 42 provides access to the interior space within ground-level enclosure 13. FIG. 1D shows an exemplary floor plan for ground-level enclosure 13, which includes an open space 44 that may be used for any purpose, including those listed above, and a bathroom 46. It is within the scope of the invention for ground-level enclosure 13 to be omitted from structure 10, in which case, the entire area beneath module 14 may be used for any existing or desired purpose (e.g., storage of items, parking of automobiles, or green space). Ground-level enclosure 13 may also be used for retail, bathrooms, office, restaurant, meeting area, and/or apartment(s), or any of the above mentioned uses. Ground-level enclosure 13 is preferably included with structure 10 when structure 10 is located in jurisdictions that mandate the provision of an accessible space within structure 10 for the accommodation of persons with physical limitations or for any other purpose. In such cases, it may need to expand and occupy a part or all of one or more adjacent parking spaces 22. Ground-level enclosure 13 may be sized to comply with any applicable laws, regulations, and/or building codes, but is preferably entirely positioned within an existing area that is un-utilized or underutilized so that it does not eliminate or detract from existing uses at the location. Ground-level enclosure 13 may be constructed from modular components that are releasably connected to each other so that it is relatively easy to deconstruct ground-level enclosure 13 and remove it from the site on which it is installed.

Module 14 is preferably a pre-assembled building or unit, the structure of which consists primarily of four walls 48*a-d*, a floor 50, and a roof 52 that enclose an interior space. Module 14 preferably also includes any necessary framing components or structural supports that may exist separately from, or be incorporated into, the walls 48*a-d*, floor 50, and roof 52. Module 14 may be constructed using an existing structure such as a shipping container and/or from discrete components assembled together to form module 14. The floor 50 of module 14 abuts and is supported by the upper surface 30 of support assembly 12. A portion of the floor 50 of module 14 also abuts and is supported by the upper surface of ground-level enclosure 13.

The interior space enclosed by the walls 48*a-d*, floor 50, and roof 52 is accessible through an opening in wall 48*d* and associated door 54. In the exemplary floor plan shown in FIG. 1D, the interior space within module 14 is habitable space that may be used as an apartment and/or a temporary lodging room. Specifically, in this exemplary embodiment, module 14 includes a bedroom 56, bathroom 58, utility area 60, kitchen 62, and living/dining area 64. The floor plan of module 14 may alternatively be designed to be larger and include additional bedrooms and/or bathrooms, or be designed as a studio space with no defined bedroom area. Furniture may be built-in to the module 14 as desired. Further, the module 14 may be completely or partially furnished with built-in furniture, removable furniture, or some combination of the two. The interior space of module 14 may alternatively be configured for use as storage space, an office, a retail store, any type of rentable space, or any other desired purpose. It is also within the scope of the invention for module 14 to include space that is not fully enclosed or that is partially enclosed. For example, module 14 may include a balcony, patio, deck, landing, or other type of outdoor space, such as rooftop access for a recreation area that may include a hot tub, pool, deck, balcony, patio or other type of outdoor space. While an exemplary floor plan is shown in FIG. 1D, it is within the scope of the invention for windows, doors, and interior layouts to be adjusted or moved.

Module 14 is preferably pre-assembled at a location remote from where it is installed, transported to the location of install, and then lifted on top of support assembly 12 by a crane or other lifting apparatus. Module 14 may be lifted and placed on top of the support assembly 12 in one piece or in multiple sections that are each individually lifted and placed on the support assembly 12. Module 14 is then preferably removably connected to support assembly 12, such that module 14 is removably supported by support assembly 12, and also may be removably connected to ground-level enclosure 13. Module 14 is preferably joined to support assembly 12 with removable fasteners, such as bolts, by connections that will be created during fabrication of the module 14, or by some other joining method that is reversible without the complete or partial destruction of components. Module 14 is preferably not permanently joined to the support assembly 12, and the exemplary joining methods described herein are not deemed to permanently join the module 14 to the support assembly 12 for purposes of this disclosure. For example, components of module 14 are preferably not fastened to or made integral with support assembly 12 in a manner that requires the complete destruction of components before module 14 may be lifted off of and removed from support assembly 12.

Figure 6C:
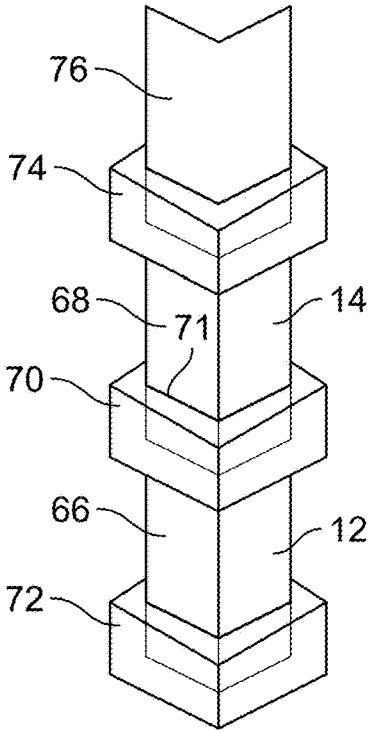
FIGS. 6A-6C show exemplary utility and structural connections for the structures shown in FIGS. 1A-5G and 8A-8J.

FIG. 6C shows an exemplary connection between module 14 and support assembly 12. In FIG. 6C, support assembly 12 includes a column 66 that is joined to a column 68 of module 14 with a connector 70. The connector 70 has a central opening 71 that receives a portion of each of columns 66 and 68 to removably join them together. Column 66 is also joined to the ground with a connector 72, which is partially buried beneath the ground level. Further, column 68 is joined via a connector 74 to a column 76 of a second module (not shown) that is removably positioned on top of and supported by module 14. The connectors 70, 72, and 74 are preferably designed to comply with applicable building regulations. Although FIGS. 1A-1C do not show a second module positioned on top of module 14, it is within the scope of the invention for additional modules to be placed on top of module 14.

Figure 6B:
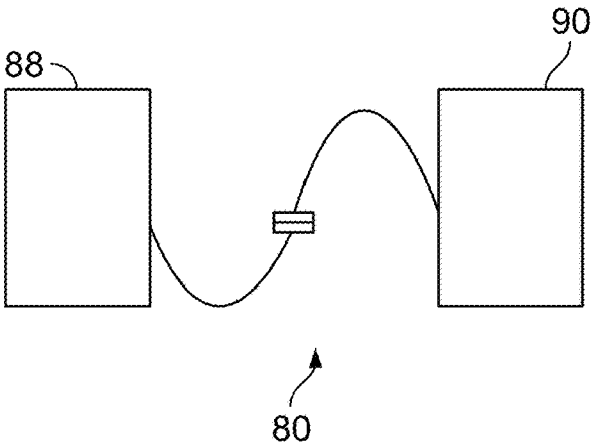
Figure 6A:
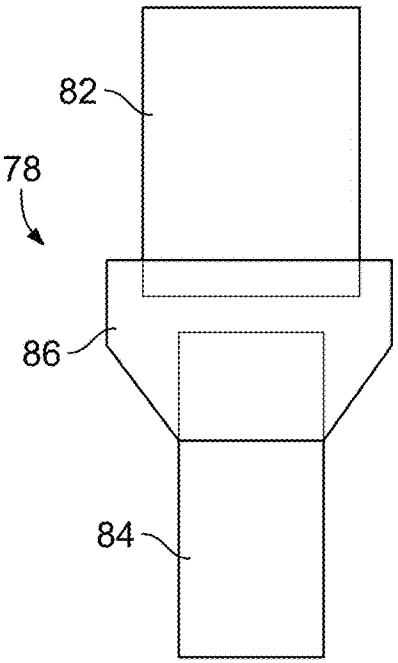

Module 14 preferably includes a plurality of utility connections that are each configured to be releasably coupled with a site utility connection at the site where structure 10 is installed. The utility connections of module 14 may include one or more of the following: electrical connection, gas connection, potable water connection, and sewer connection. The utility connections of module 14 are preferably positioned near or adjacent the floor 50 of module 14 so that they may be connected to utilities installed at the site where structure 10 is located or, if module 14 is placed on top of another like module, as described below, the utility connections may releasably connect to inter-module utility connections positioned near or adjacent the roof 52 of the lower module 14. FIGS. 6A-6B show two exemplary utility connections for module 14, a sewer connection 78 and an electrical connection 80. For the sewer connection 78, module 14 includes a sewer outlet pipe 82 that is releasably coupled with a sewer inlet pipe 84 installed at the site where structure 10 is located. Sewer inlet pipe 84 includes an opening surrounded by a flange 86 that is larger than sewer outlet pipe 82 to facilitate the releasable connection. Electrical connection 80 is made between an electrical panel 88 installed at the site where structure 10 is located and an electrical panel 90 of module 14. Electrical connection 80 preferably may include electrical service, low voltage, data, fiber optic and/or any other similar service. For any utilities that are not available at the site where structure 10 is located, or if it is not desired to connect module 14 to a particular utility service, module 14 may include connections or apparatuses designed to provide the same or similar service. For example, module 14 may include one or more electrical generating apparatuses (e.g., gas powered generator, wind turbine, solar panel, or geothermal electrical generating system) in lieu of, or in addition to, being connected to an electric utility available at the site where structure 10 is installed. A geothermal heat pump system may also be used to heat and cool module 14, in lieu of, or in addition to, an alternative heating and cooling system. Module 14 may include a potable water storage reservoir that is refilled when depleted by rainwater, delivery of potable water, or otherwise, in lieu of, or in addition to, being connected to a potable water source available at the site where structure 10 is installed. Module 14 may include a gas storage reservoir, such as a propane tank, in lieu of, or in addition to, being connected to a gas utility available at the site where structure 10 is installed. The propane tank may be refilled or replaced when depleted. Further, module 14 may include a sewage reservoir for receiving sewage generated within module 14, in lieu of, or in addition to, being connected to a sewer system available at the site where structure 10 is installed.

When module 14 is installed on top of support assembly 12 and ground-level enclosure 13, an accessible volume of space 92 is positioned below at least a portion of module 14. The accessible volume of space 92 preferably has a height that is sufficient to park an automobile within the accessible volume of space 92. As shown in FIG. 1C, three parking spaces 22*a-c* are positioned in the accessible volume of space 92 beneath, or at least partially beneath, module 14. Column 34, and the other adjacent components of support assembly 12, are positioned between adjacent parking spaces 22*a-b* so that support assembly 12 does not eliminate one of the parking spaces 22*a-b* for use. As described above, if ground-level enclosure 13 is omitted from structure 10, accessible volume of space 92 may also incorporate the area beneath module 14 that is taken up by ground-level enclosure 13. It is also within the scope of the invention for structure 10 and/or ground-level enclosure 13 to occupy or restrict parking depending on specific site and/or regulatory constraints.

As shown in the figures related to some of the alternative embodiments described below, additional modules (not shown), which may be similar or identical to module 14, may be placed on top of and be supported by module 14. Any number of modules 14 may be placed on top of support assembly 12 as allowed under any applicable laws, regulations, and codes. In order to accommodate additional modules 14 being placed thereon, module 14 preferably includes one or more inter-module utility connections. For example, module 14 may include an electrical connection, gas connection, potable water connection, a data, fiber optic, and/or low voltage connection, and sewer connection that are positioned adjacent roof 52 and designed for releasable connection with the utility connections of an upper module (not shown) placed on top of and supported by module 14. As described above, such utility connections of the upper module are preferably located near or adjacent the floor of the upper module so that they may be releasably connected with the inter-module utility connections near the roof 52 of a lower module 14. The utility connections located near the floor 50 of a module 14 are preferably designed for quick, releasable connection with the inter-module utility connections located near the roof 52 of a module 14. For example, the utility connections located near the floor 50 may be male connectors, and the inter-module utility connections located near the roof 52 may be female connectors, or vice versa. Within a single module 14, the utility connections and inter-module utility connections are in communication with each other so that the module 14 can provide continuous utility service to any modules positioned above it.

Further, in order to accommodate additional modules 14, structure 10 preferably includes above ground walkways that provide access between adjacent modules 14 and access system 16. The above ground walkways may be external (i.e., positioned outside of the exterior walls of modules 14) or internal (i.e., positioned within the exterior walls of modules 14 or covered, partially enclosed, or fully enclosed in some manner). FIGS. 7D-E described below show examples of walkways that may be used with structure 10.

Access system 16 is configured to allow a person on the ground, or adjacent the lower surface 28 of support assembly 12, to move vertically upward adjacent the upper surface 30 of support assembly 12 to a position where the person may access the door 54 of module 14 and enter module 14. As best shown in FIG. 1B, access system 16 includes stairs that extend vertically upward from the ground to door 54 of module 14. Alternatively, access system 16 may include a ladder, an elevator, and/or any other structure that allows a person to move vertically upward to door 54 as required by building code or other governing bodies. Access system 16 may comprise a pull-down or drop-down ladder and/or stairs when structure 10 is located at a site where there is little space for a larger type of access system, e.g., when access system 16 is located in the island of a parking lot, or when it is necessary or desirable for portions of the access system 16 to be vertically retractable so that the entire area beneath access system 16 is accessible. The access system comprised of a ladder or stairs may be counter weighted and/or hydraulically mechanized to facilitate retractability as required. While the structure 10 shown in FIGS. 1A-1C shows access system 16 being positioned outside of ground-level enclosure 13, access system 16 may be entirely or at least partially positioned within ground-level enclosure 13. When access system 16 is stairs, as shown in FIG. 1B, there is an accessible volume of space 94 beneath access system 16 that may be used for any suitable purpose, for example, as storage or automobile parking. The area beneath access system 16 may also be fenced or walled-in to provide secure, rentable storage space. Access system 16 may be constructed from modular components that are releasably connected to each other so that it is relatively easy to deconstruct access system 16 and remove it from the site on which it is installed.

The exterior walls of structure 10 may include advertising and/or branding for existing and/or future buildings in the vicinity, such as retail, neighborhood districts, projects, hotels, and/or storage sites.

Figure 2A:
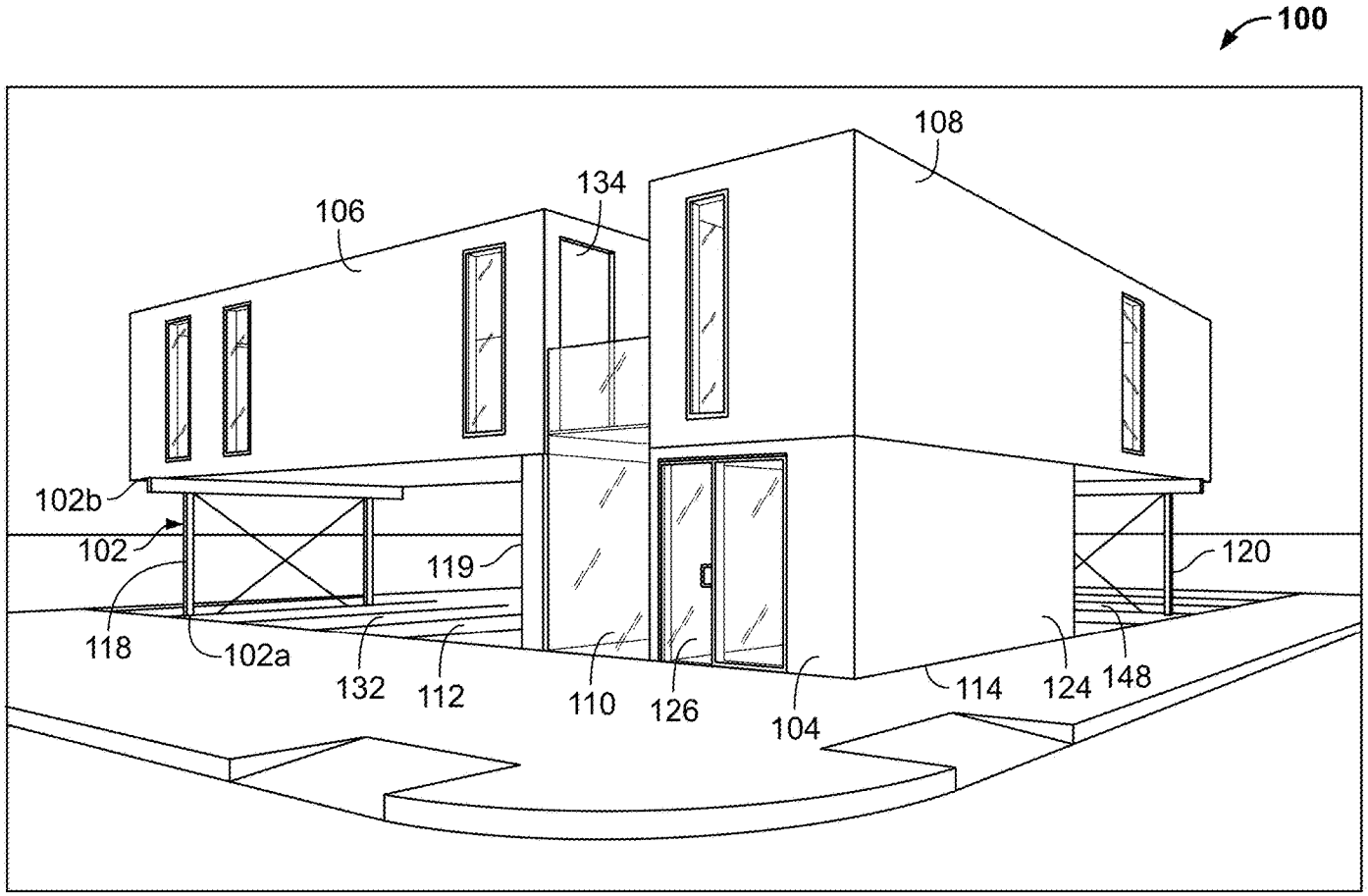
FIGS. 2A-2B show perspective views of a second exemplary embodiment of structure in accordance with the invention described herein.
Figure 2B:
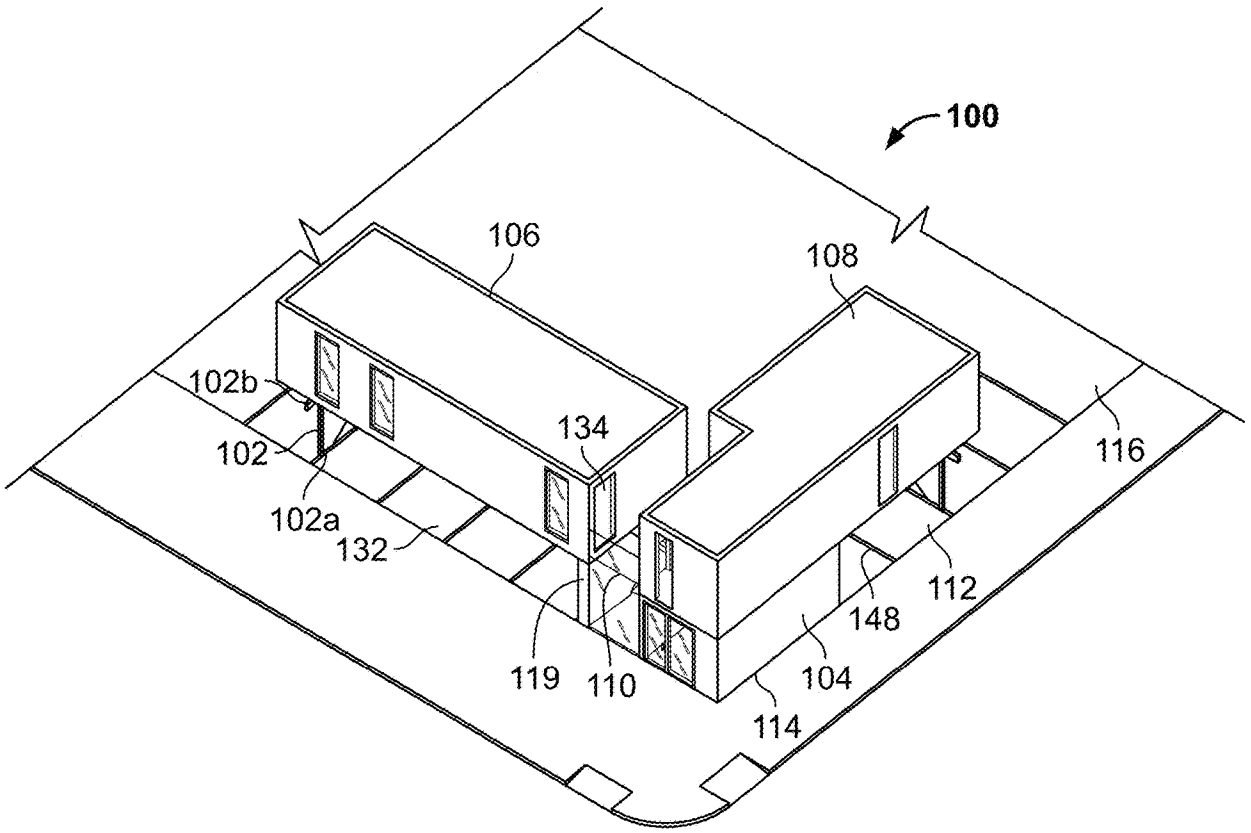

Referring now to FIGS. 2A-2B, an alternative embodiment of structure in accordance with the invention described herein is identified generally as 100. Structure 100 includes a support assembly 102, a ground-level enclosure 104, a first module 106, a second module 108, and an access system 110. Like structure 10, structure 100 is also shown in FIGS. 2A-2B as being located in the corner of a parking lot 112, and it is within the scope of the invention for structure 100 to be located in any desired location. Ground-level enclosure 104 and access system 110 are located in a corner section 114 of the parking lot 112 in an area that is conventionally un-utilized or underutilized due to the configuration of the parking spaces 116 located in the parking lot 112. Ground-level enclosure 104 and access system 110 preferably do not eliminate any of the parking spaces 116 within the parking lot 112.

Support assembly 102 may be constructed from any of the components described above, and by any of the methods described above, in connection with support assembly 12. Unlike support assembly 12, support assembly 102 extends outward from the corner section 114 of the parking lot 112 in two directions to form an L-shape. FIG. 2A shows a first end section 118 of support assembly 102 spaced outward in one direction from corner section 114, a middle section 119 located in corner section 114, and a second end section 120 of support assembly 102 spaced outward in a second direction from corner section 114. Support assembly 102 includes a lower surface 102*a* that is supported by the ground and an upper surface 102*b*, which is spaced above lower surface 102*a* and supports first and second modules 106 and 108.

Ground-level enclosure 104 is supported by support assembly 102 and the ground beneath a portion of second module 108. Ground-level enclosure 104 includes four walls 124 that enclose an interior space, which may be used for any desired purpose, such as an apartment, a lodging room, a retail store, storage, restaurant, a live-work unit, or an office. A door 126 provides access to the interior space within ground-level enclosure 104. FIG. 2D shows an exemplary floor plan for ground-level enclosure 104, which includes an open space 128 that may be used for any purpose, including those listed above, and a bathroom 130. It is within the scope of the invention for ground-level enclosure 104 to be omitted from structure 100, in which case, the entire area beneath second module 108 may be used for any existing or desired purpose (e.g., storage of items, parking of automobiles, or green space). As described above with respect to ground-level enclosure 13, ground-level enclosure 104 is preferably included with structure 100 as necessary to comply with any applicable laws, regulations, and/or building codes, which may require expansion and the use of adjoining parking space(s).

First and second modules 106 and 108 may be constructed from any of the components described above, and by any of the methods described above, in connection with module 14. Further, first and second modules 106 and 108 may be used for any of the purposes described above in connection with module 14, and include any of the alternative features described above in connection with module 14. First and second modules 106 and 108 are also preferably removably joined to, and supported by, support assembly 102 in accordance with any of the methods and components described above with respect to module 14. In addition, first and second modules 106 and 108 preferably include similar utility and inter-module utility connections as described above in connection with module 14. Only the differences between first and second modules 106 and 108 and module 14 are described in detail herein.

First module 106 is supported by the first end section 118 and middle section 119 of support assembly 102, and is positioned over five parking spaces 116 in parking lot 112 to create an accessible volume of space 132 beneath first module 106. Accessible volume of space 132 is preferably sized to allow five automobiles to park beneath first module 106, but may have any size and be used for any purpose including those described above in connection with structure 10. FIG. 2D shows an exemplary floor layout of first module 106. First module 106 includes a door 134 permitting access to an enclosed interior space. First module 106 includes a bedroom 136, bathroom 138, utility area 140, kitchen 142, living/dining area 144, and closet 146.

Second module 108 is supported by the ground-level enclosure 104 (and/or portions of the support assembly 102 incorporated into the ground-level enclosure 104) and second end section 120 of support assembly 102, and is positioned over three parking spaces 116 in parking lot 112 to create an accessible volume of space 148 beneath second module 108. Ground-level enclosure 104 is positioned beneath a portion of second module 108. Accessible volume of space 148 is preferably sized to allow three automobiles to park beneath second module 108, but may have any size and be used for any purpose including those described above in connection with structure 10. FIG. 2D shows an exemplary floor layout of second module 108. Second module 108 includes a door 150 permitting access to an enclosed interior space. Second module 108 is configured as a studio space including a living/dining/bedroom/kitchen area 152, bathroom 154, utility area 156, and closet 158.

Access system 110 may be constructed from any of the components described above, and by any of the methods described above, in connection with access system 16. Further, access system 110 may be used for any of the purposes described above in connection with access system 16, and include any of the alternative features described above in connection with access system 16. Only the differences between access system 110 and access system 16 are described in detail herein.

Access system 110 is configured to allow a person on the ground, or adjacent the lower surface 102*a* of support assembly 102 to move vertically upward adjacent the upper surface 102*b* of support assembly 102 to a position where the person may access the doors 134 and 150 of first and second modules 106 and 108, respectively. Access system includes a first set of stairs 160, shown in FIG. 2D, that extends upward from the ground to a first stair landing 162, and a second set of stairs 164 that extends upward from first stair landing 162 to a second stair landing 166. Second stair landing 166 is at the same level as doors 134 and 150 of first and second modules 106 and 108 so that a person on second stair landing 166 may access the interior spaces of first and second modules 106 and 108. Access system 110 is positioned between ground-level enclosure 104 and middle section 119 of support assembly 102 and between first and second modules 106 and 108. Addition or subtraction of floors and stair landings may be utilized in a similar fashion as described above.

Figure 2C:
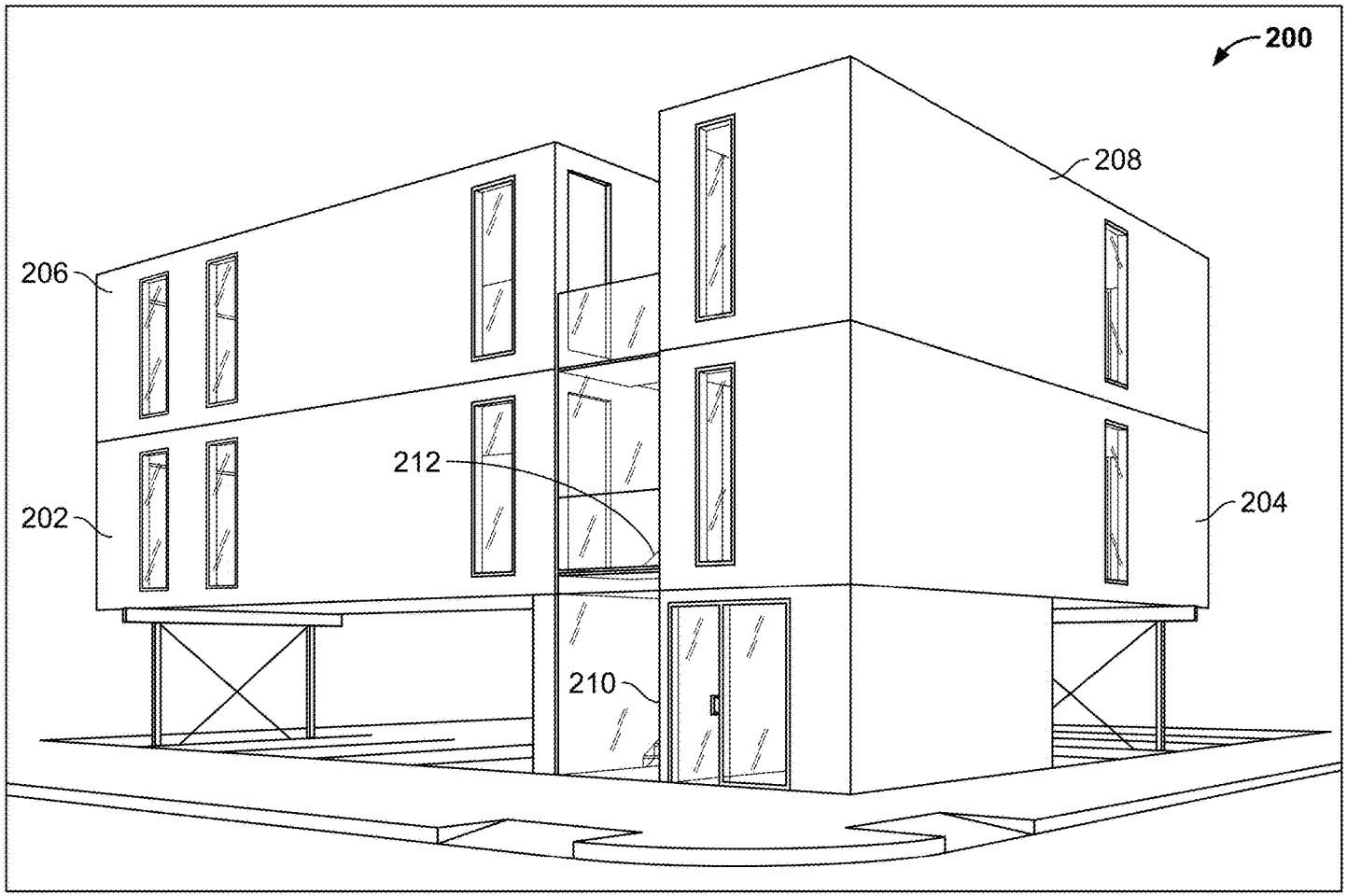
FIG. 2C shows a perspective view of the structure shown in FIGS. 2A-2B with a third level added.
Figure 2D:
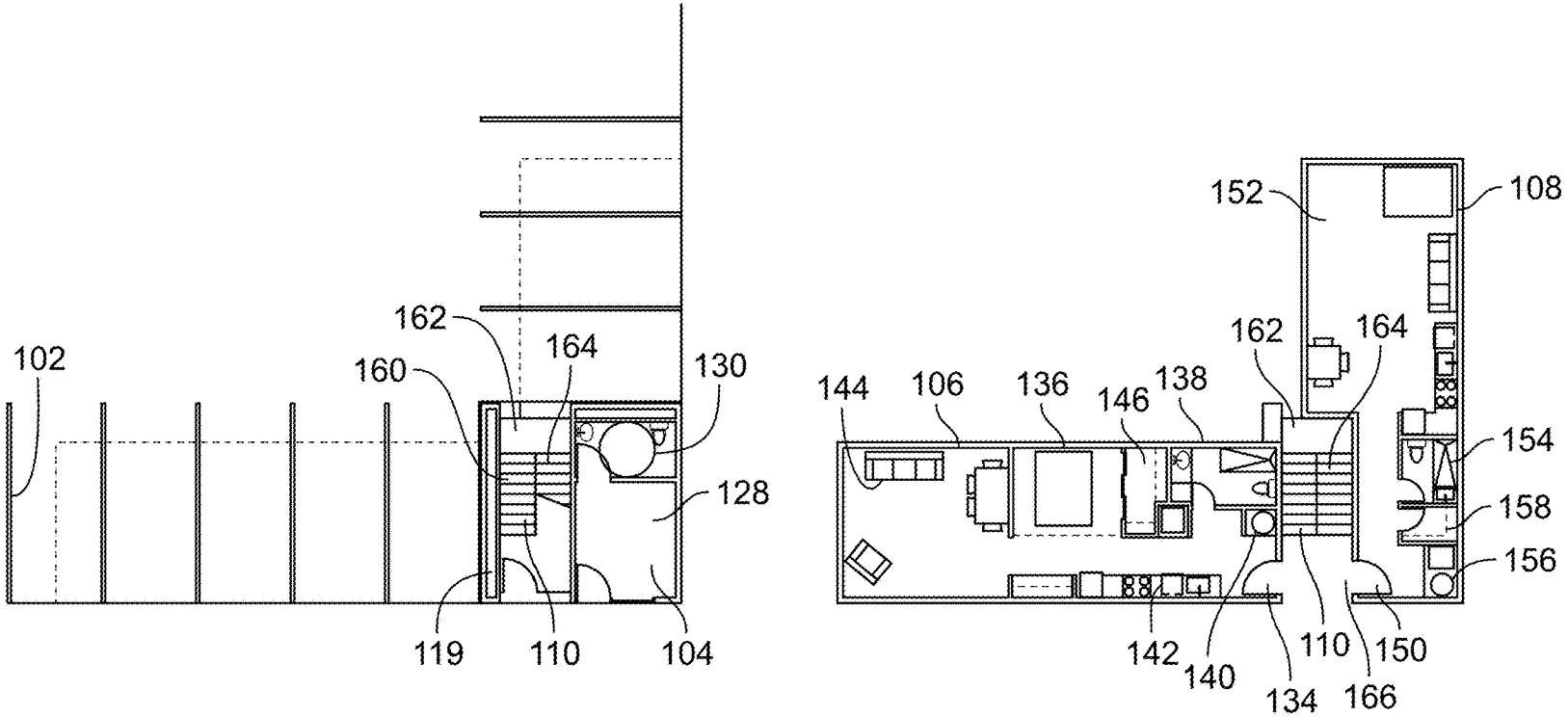
FIG. 2D shows plan views of an exemplary floor layout for the structure shown in FIGS. 2A-2C.

FIG. 2C shows an alternative embodiment of structure 200 that is substantially similar to structure 100 except that it includes first, second, third and fourth modules 202, 204, 206, and 208. First and second modules 202 and 204 are positioned in the same location as the first and second modules 106 and 108 of structure 100, and third and fourth modules 206 and 208 are positioned on top of, and removably supported by, upper surfaces of first and second modules 202 and 204, respectively. Third and fourth modules 206 and 208 are preferably not permanently joined to first and second modules 202 and 204 so that they may be lifted off, slid off, or otherwise removed off of first and second modules 202 and 204 in a manner similar to as described above with respect to lifting module 14 off of support assembly 12. Third and fourth modules 206 and 208 may be removably joined to first and second modules 202 and 204 in a similar manner as described above with respect to the connector 74 shown in FIG. 6C. The access system 210 of structure 200 also includes an additional set of stairs 212 that extend upward to provide access to third and fourth modules 206 and 208. It is within the scope of the invention for structure 200 to include additional modules positioned on top of, and supported by, third and fourth modules 206 and 208, and for access system 210 to extend upward to provide access to any number of modules above third and fourth modules 206 and 208. Third and fourth modules 206 and 208 preferably access utilities from first and second modules 202 and 204 with utility connections of third and fourth modules 206 and 208 that are releasably connected to inter-module utility connections of first and second modules 202 and 204, as described above. Further, it is within the scope of the invention for any of the structures described herein, including structures 100 and 200, to include additional modules that are positioned on top of a support assembly adjacent to, and at the same level as, the modules shown in the Figures.

Referring to FIGS. 3A-3D, another alternative embodiment of structure in accordance with the invention described herein is identified generally as 300. Structure 300 is similar to structures 10, 100, and 200 described above. Accordingly, only the differences between structure 300 and structures 10, 100, and 200 are described herein.

Figure 3A:
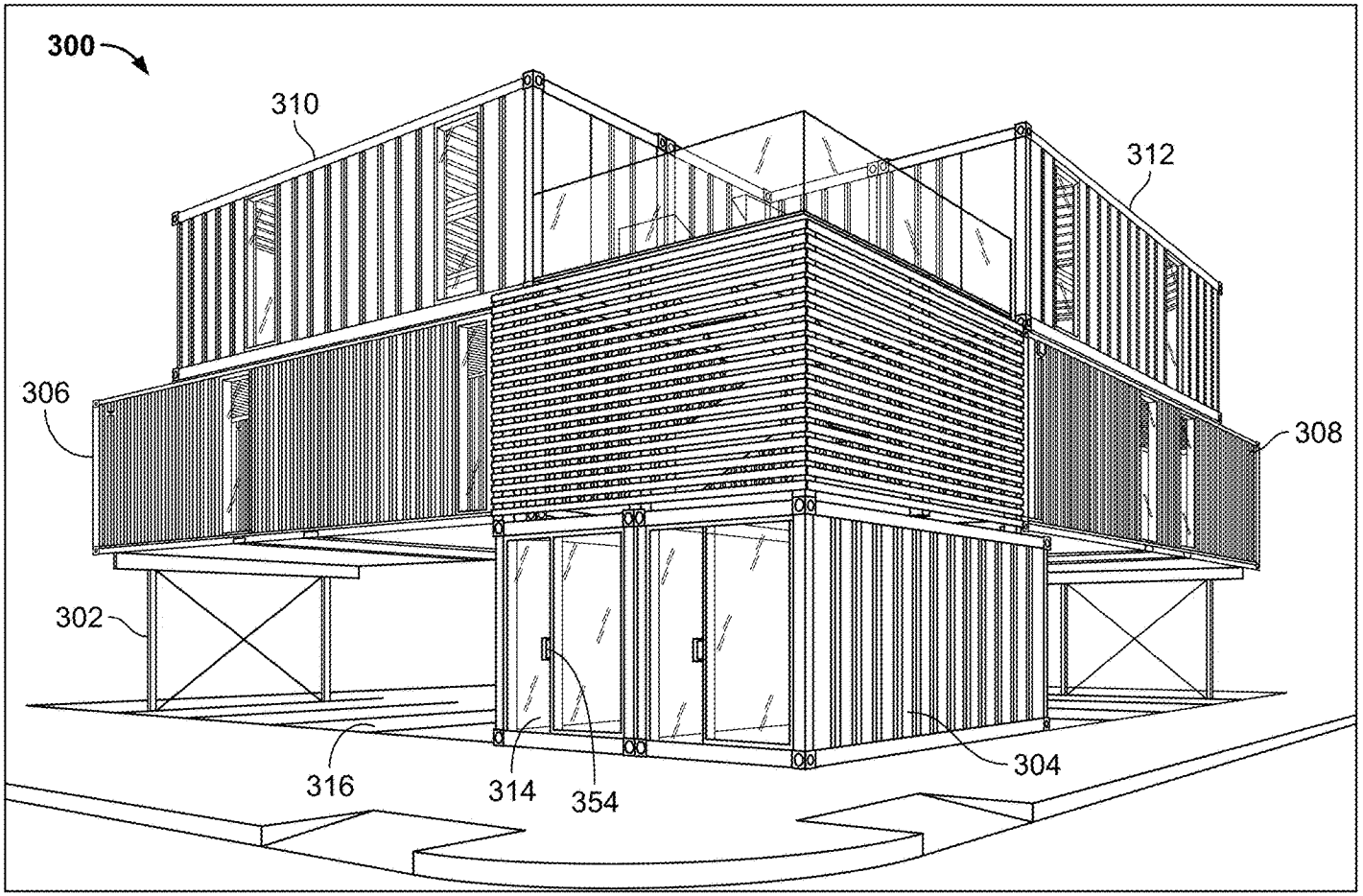
FIGS. 3A-3B show perspective views of a third exemplary embodiment of structure in accordance with the invention described herein.
Figure 3B:
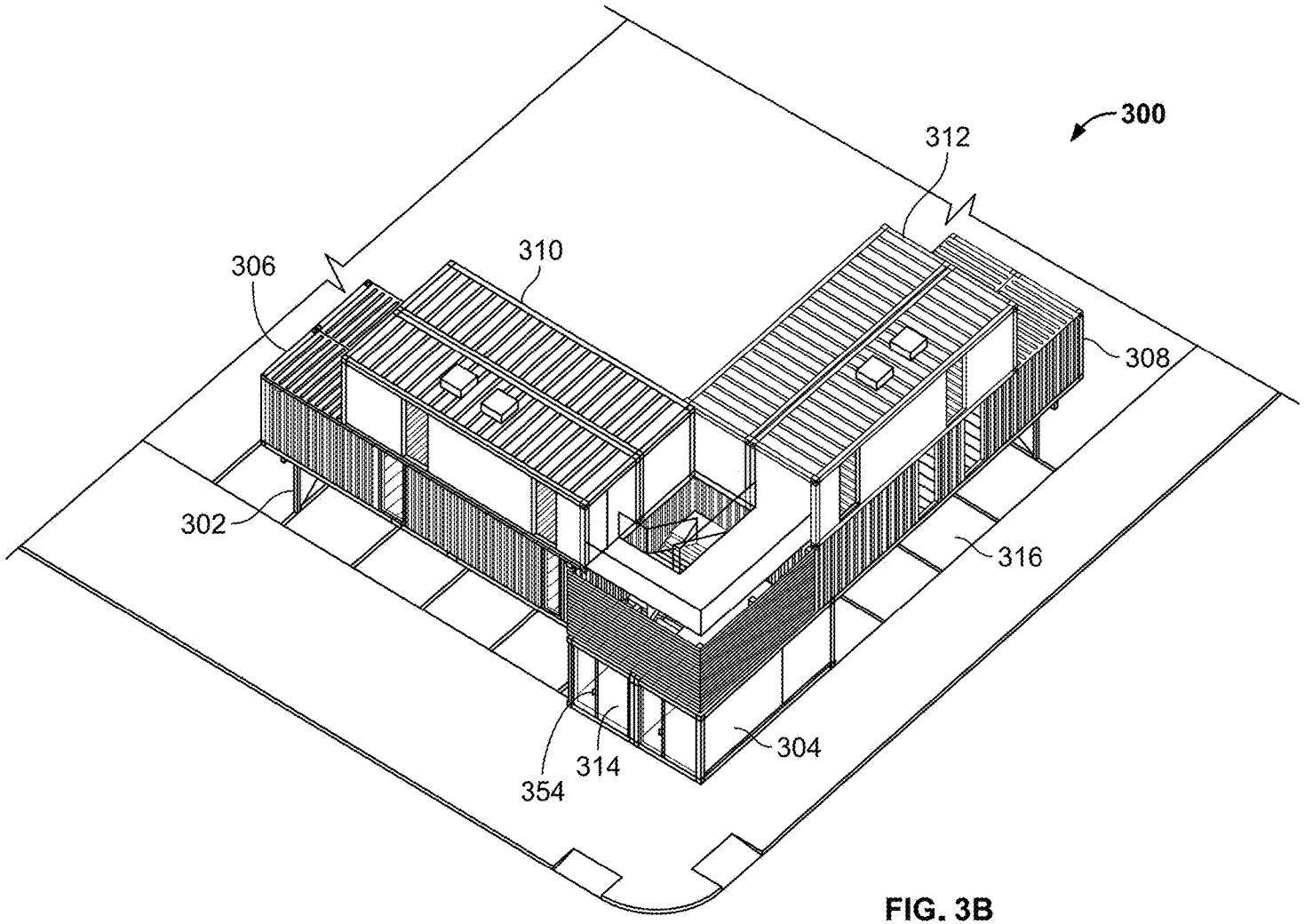

Structure 300 includes a support assembly 302, a ground-level enclosure 304, a first module 306, a second module 308, a third module 310, a fourth module 312, and an access system 314. Like structure 10, structure 300 is also shown in FIGS. 3A-3B as being located in the corner of a parking lot 316, and it is within the scope of the invention for structure 300 to be located in any desired location.

Figure 3C:
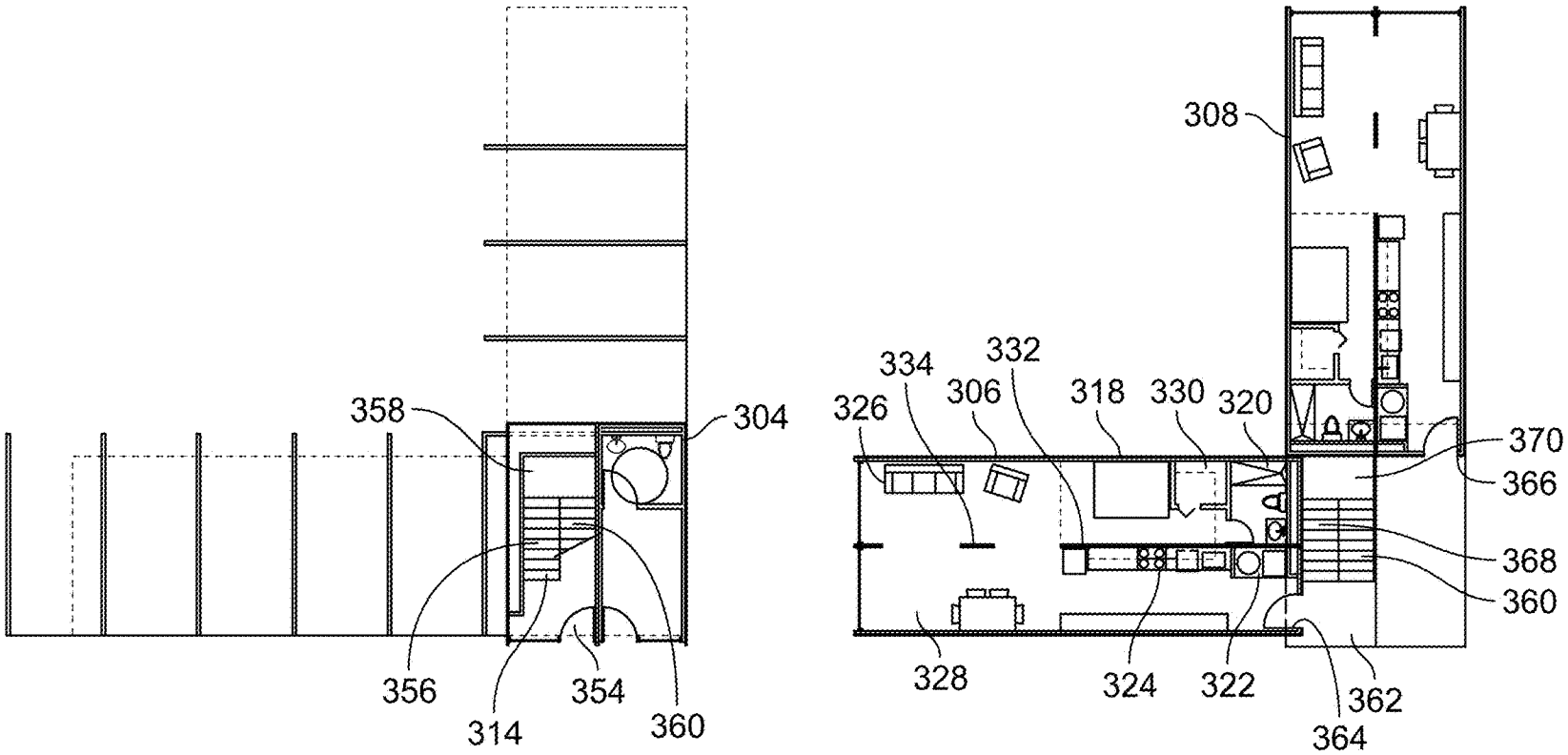
FIGS. 3C-3D show plan views of an exemplary floor layout for the structure shown in FIGS. 3A-3B.

First module 306 and second module 308 are removably supported by support assembly 302 in a substantially similar manner as the first and second modules 106 and 108 of structure 100, except that first and second modules 306 and 308 are slightly wider than first and second modules 106 and 108 to provide more space for an occupant. Referring to FIG. 3C, an exemplary floor layout of first module 306 includes a bedroom 318, bathroom 320, utility area 322, kitchen 324, living area 326, dining area 328, and closet 330. A dividing wall 332 is positioned between the bedroom 318 and kitchen 324, and a partial dividing wall 334 is positioned between the living area 326 and dining area 328. The exemplary floor layout of second module 308 is a mirror image of first module 306 and is thus not described in detail herein.

Figure 3D:
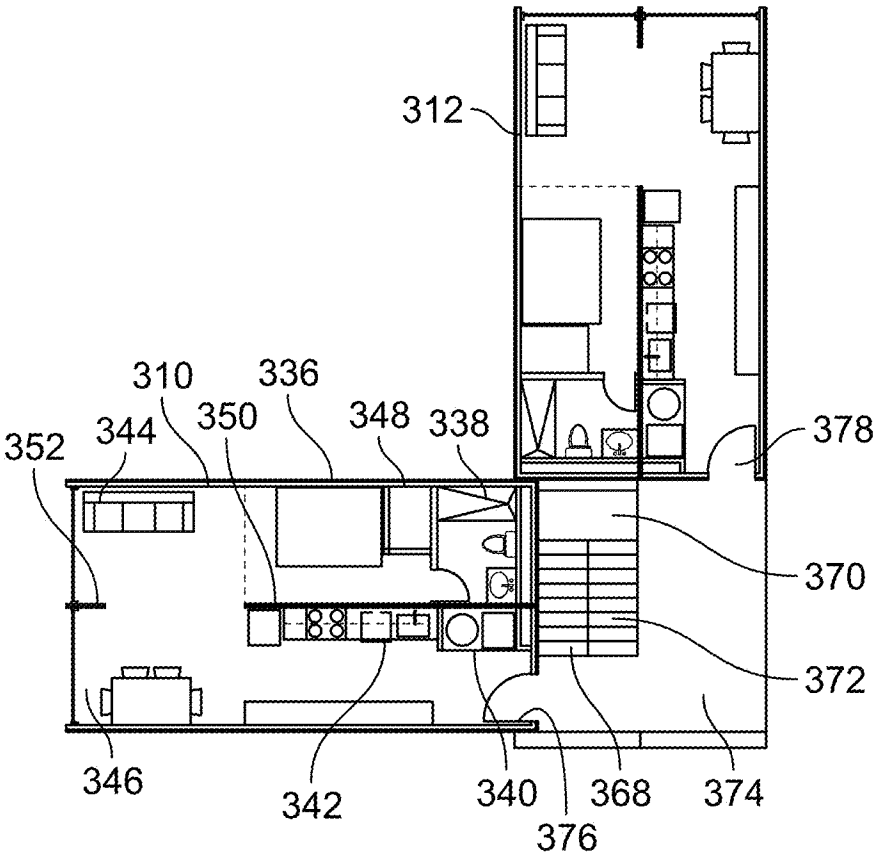

Third and fourth modules 310 and 312 are removably supported by upper surfaces of first and second modules 306 and 308, respectively, in a similar manner as described above with respect to structure 200. Referring to FIG. 3D, an exemplary floor layout of third module 310 includes a bedroom 336, bathroom 338, utility area 340, kitchen 342, living area 344, dining area 346, and closet 348. A dividing wall 350 is positioned between the bedroom 336 and kitchen 342, and a partial dividing wall 352 is positioned between the living area 344 and dining area 346. The exemplary floor layout of fourth module 312 is a mirror image of third module 310 and is thus not described in detail herein.

Access system 314 is positioned adjacent ground-level enclosure 304 and includes an enclosed lower level with a door 354. Referring to FIGS. 3C and 3D, a first set of stairs 356 extends upward from the ground to a first stair landing 358, and a second set of stairs 360 extends upward from the first stair landing 358 to a second stair landing 362. Doors 364 and 366 of first and second modules 306 and 308 are accessible from second stair landing 362. A third set of stairs 368 extends upward from the second stair landing 362 to a third stair landing 370, and a fourth set of stairs 372 extends upward from the third stair landing 370 to a fourth stair landing 374. Doors 376 and 378 of third and fourth modules 310 and 312 are accessible from fourth stair landing 374.

Figure 4A:
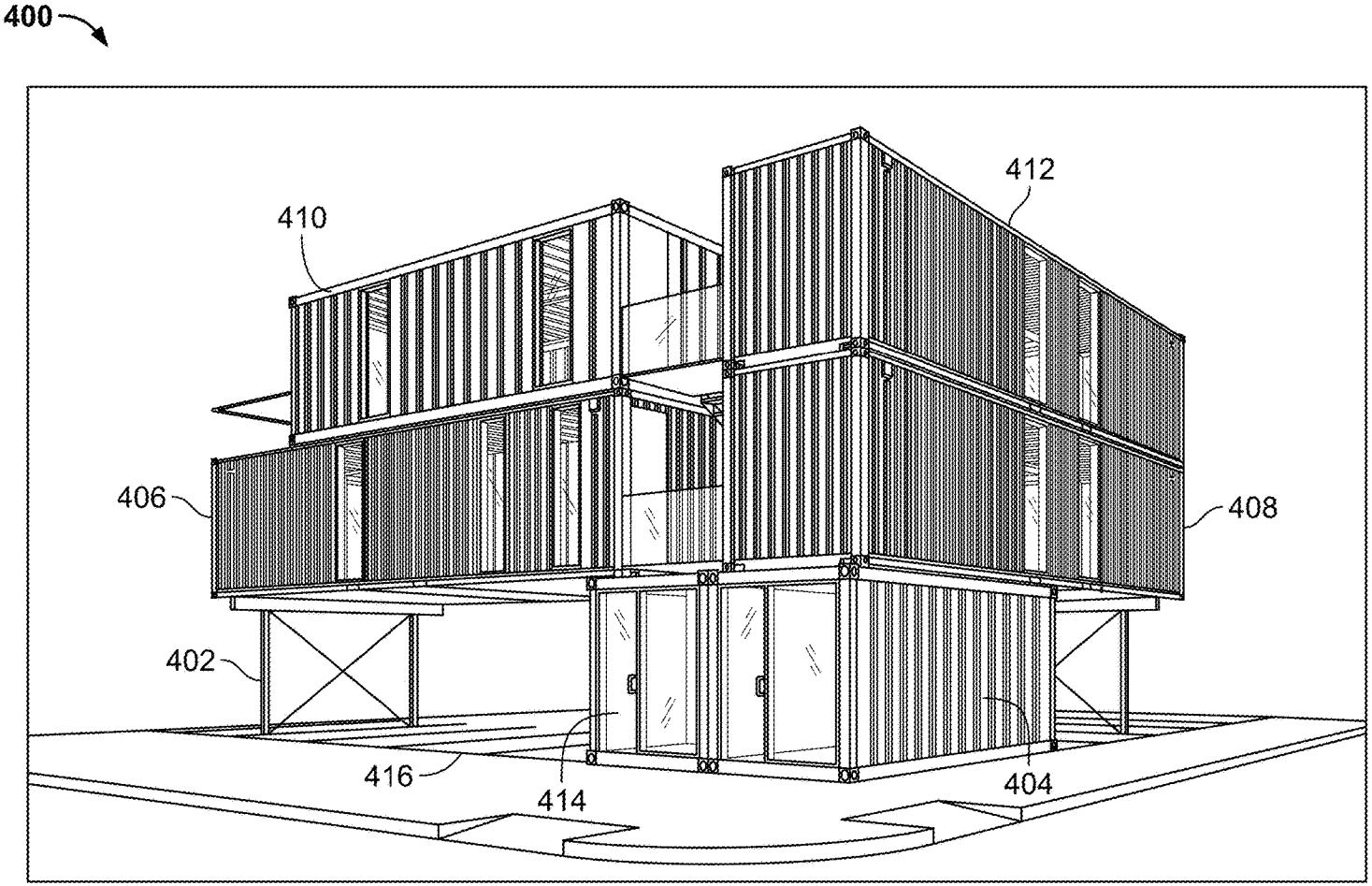
FIGS. 4A-4B show perspective views of a fourth exemplary embodiment of structure in accordance with the invention described herein.
Figure 4B:
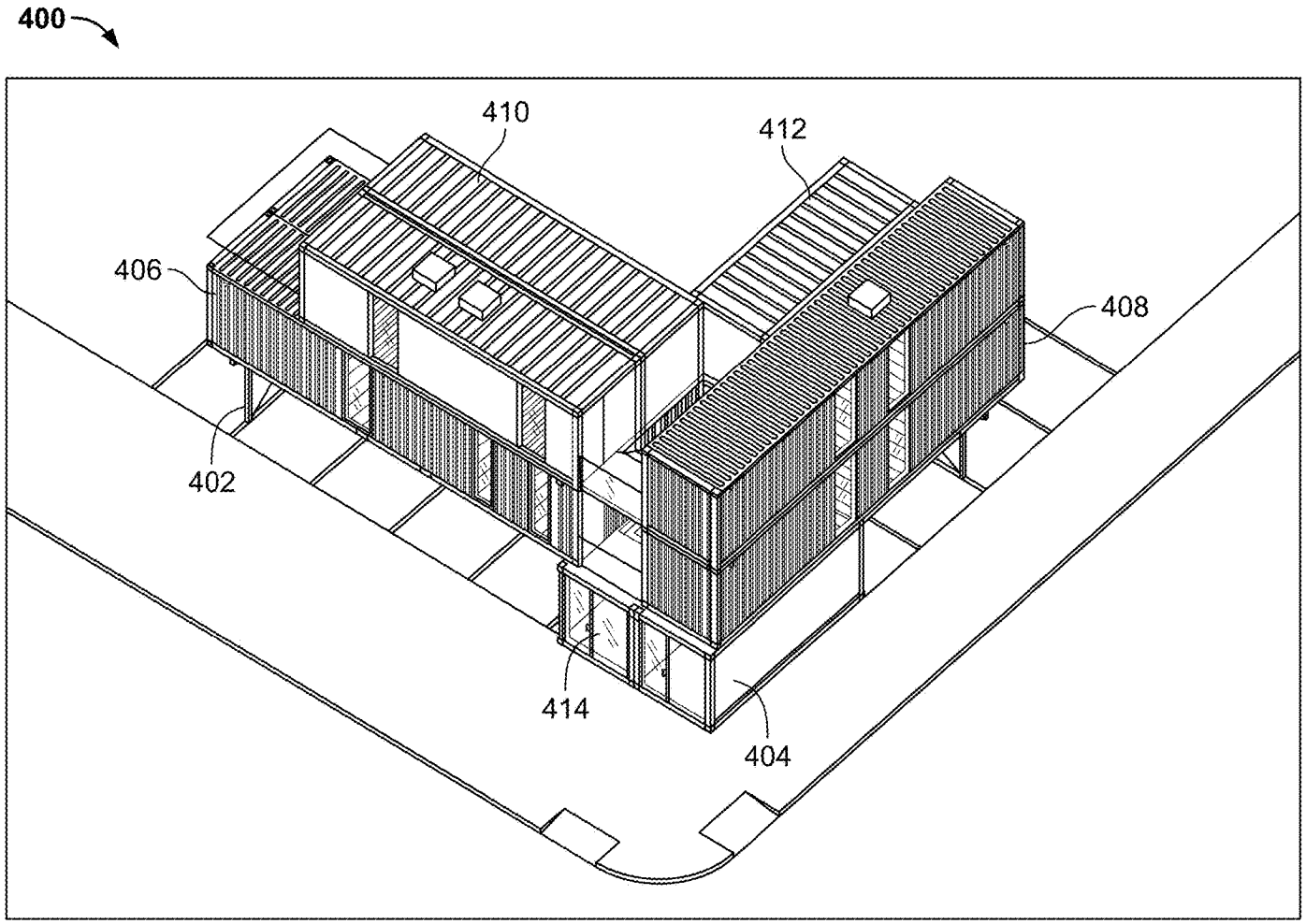
Figure 4C:
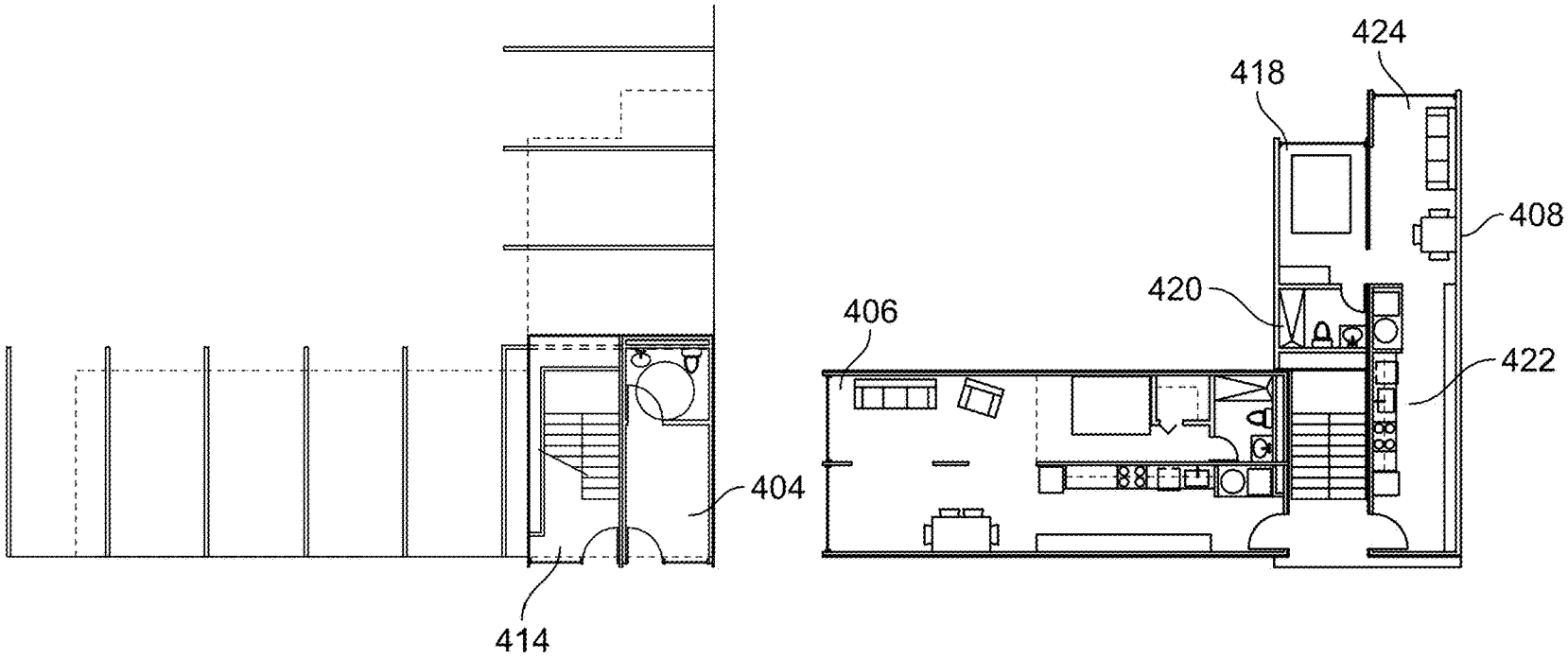
FIG. 4C shows plan views of an exemplary floor layout for the structure shown in FIGS. 4A-4B.

FIGS. 4A-4C show an alternative embodiment of structure 400 in accordance with the invention described herein. Structure 400 is similar to structures 10, 100, 200, and 300 described above. Accordingly, only the differences between structure 400 and structures 10, 100, 200, and 300 are described herein.

Structure 400 includes a support assembly 402, a ground-level enclosure 404, a first module 406, a second module 408, a third module 410, a fourth module 412, and an access system 414. Like structure 10, structure 400 is also shown in FIGS. 4A-4B as being located in the corner of a parking lot 416, and it is within the scope of the invention for structure 400 to be located in any desired location.

First module 406 and second module 408 are removably supported by support assembly 402 in a substantially similar manner as the first and second modules 106 and 108 of structure 100, except that first and second modules 406 and 408 are slightly wider than first and second modules 106 and 108 to provide more space for an occupant. Referring to FIG. 4C, an exemplary floor layout of first module 406 is substantially similar to the floor layout of first module 306 shown in FIG. 3C and is thus not described in detail herein. An exemplary floor layout of second module 408 includes a bedroom 418, bathroom 420, kitchen 422, and living area 424. A dividing wall 426 is positioned between the bedroom 418 and living area 424. First module 406 and second module 408 may include any other space as desired for use as retail, office, temporary lodging, storage, and/or restaurant.

Third and fourth modules 410 and 412 are removably supported by upper surfaces of first and second modules 406 and 408, respectively, in a similar manner as described above with respect to structures 200 and 300. The floor layouts of third and fourth modules 410 and 412 may be substantially similar to the layouts of first and second modules 406 and 408, respectively.

Access system 414 has a substantially similar structure and function as access system 314 described above. Thus, access system 414 is not described in detail herein.

FIGS. 5A-5G show an alternative embodiment of structure 500 in accordance with the invention described herein. Structure 500 is similar to structures 10, 100, 200, 300, and 400 described above. Accordingly, only the differences between structure 500 and structures 10, 100, 200, 300, and 400 are described herein. Unlike structures 10, 100, 200, 300, and 400 described above, structure 500 does not have a ground-level enclosure.

Figure 5A:
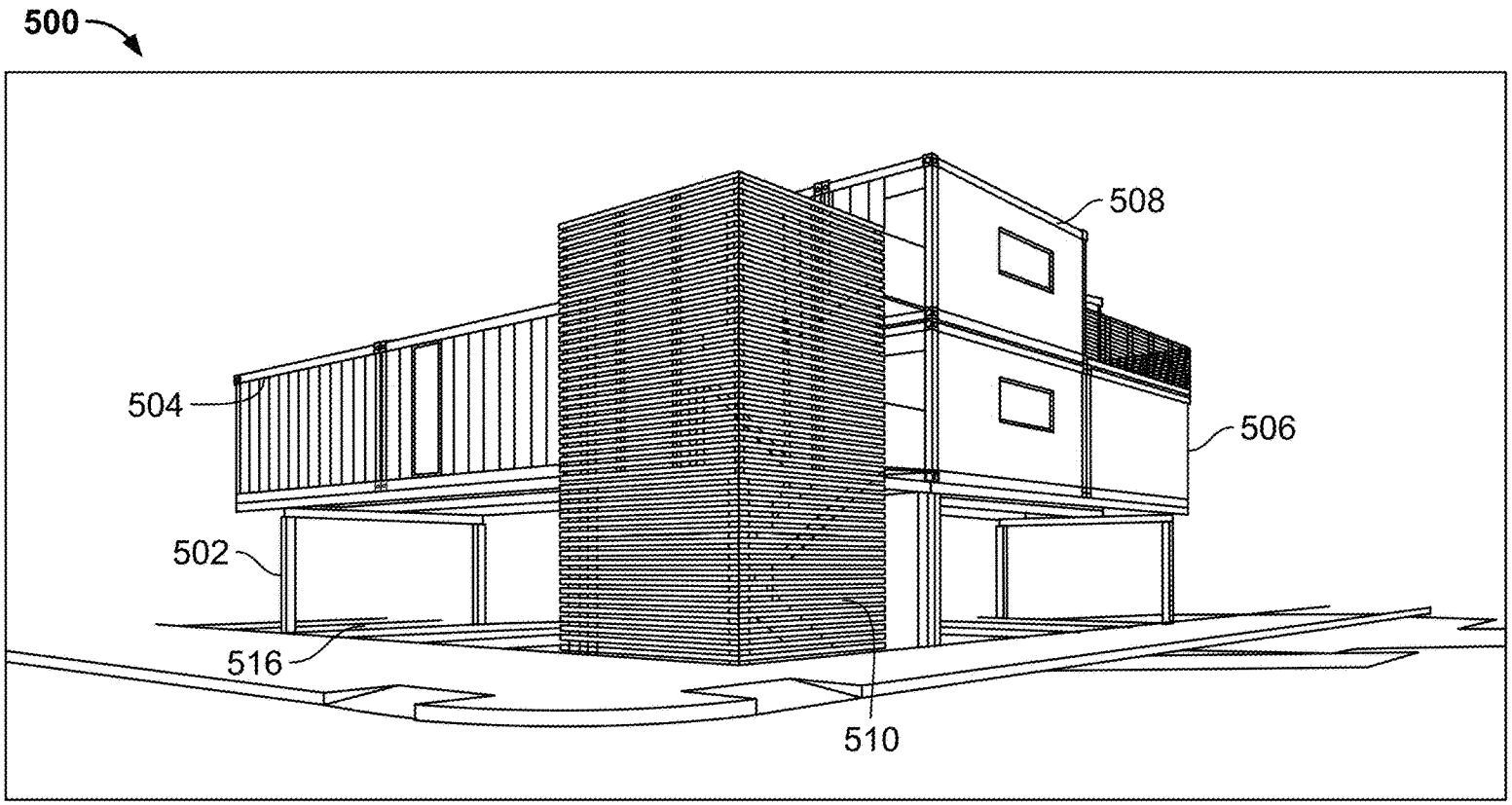
FIGS. 5A-5C show perspective views of a fifth exemplary embodiment of structure in accordance with the invention described herein.
Figure 5B:
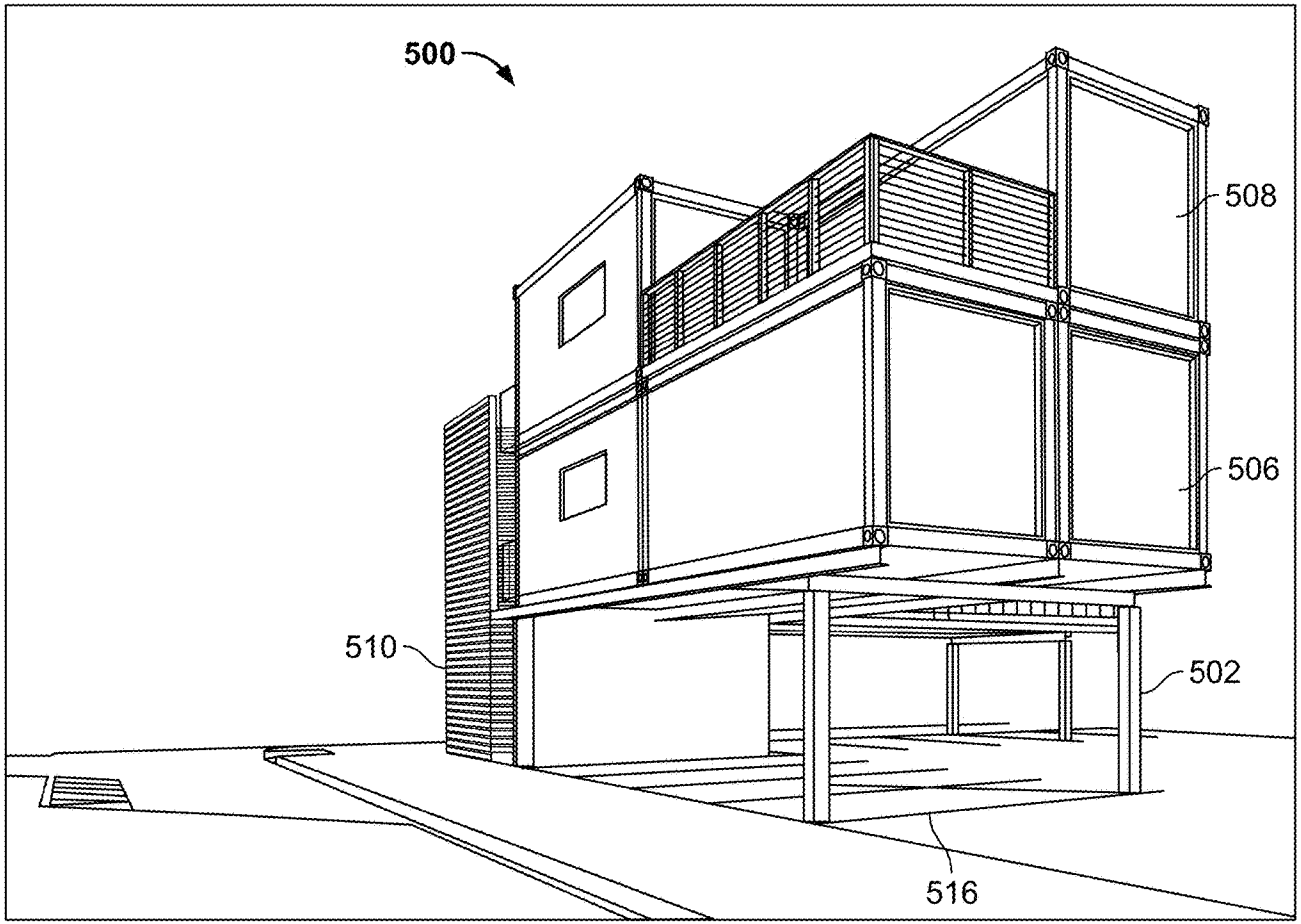
Figure 5C:
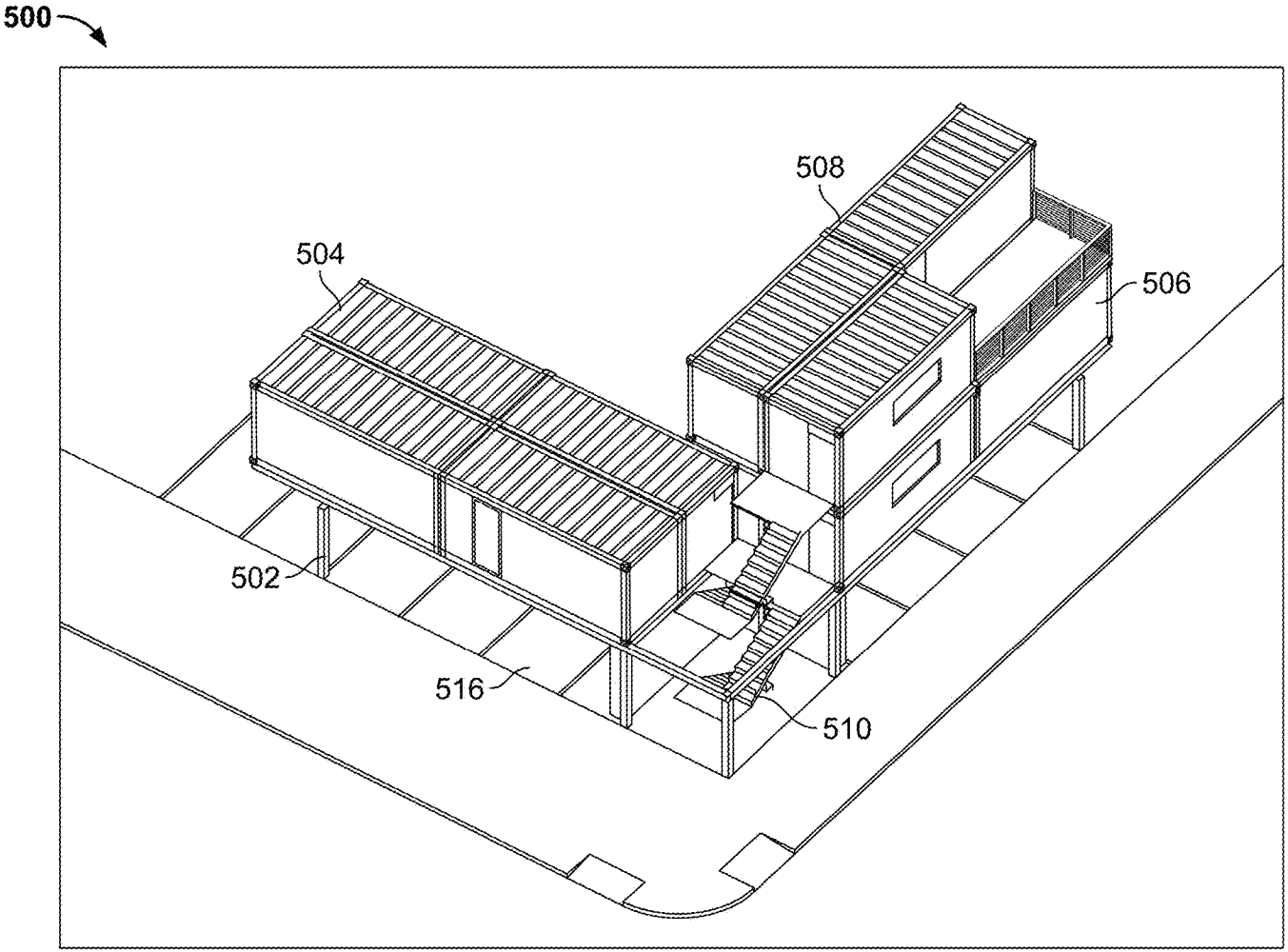
Figure 5D:
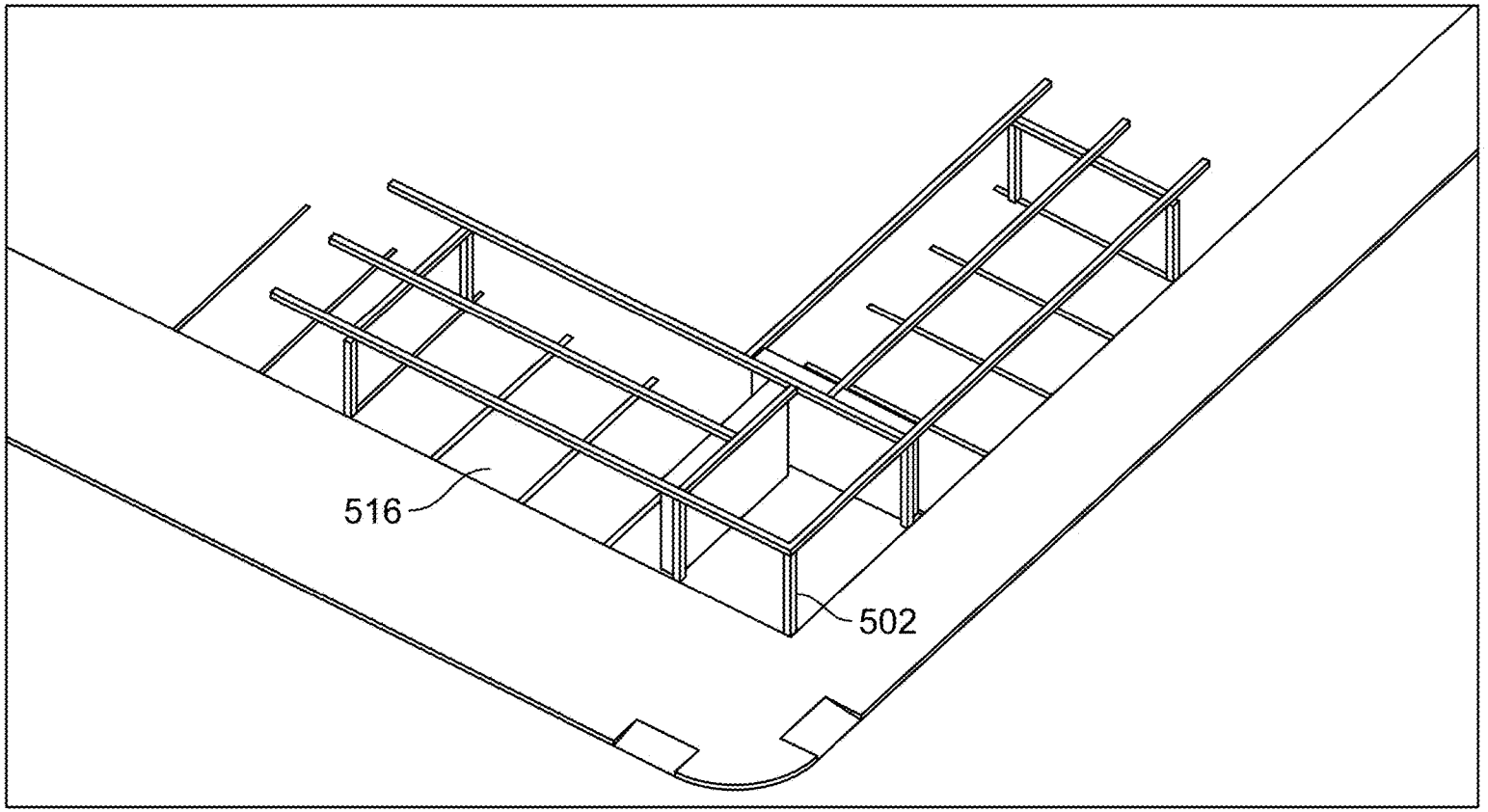
FIG. 5D shows a perspective view of a support assembly of the structure shown in FIGS. 5A-5C.

Structure 500 includes a support assembly 502, a first module 504, a second module 506, a third module 508, and an access system 510. Like structure 10, structure 500 is also shown in FIGS. 5A-5C as being located in the corner of a parking lot 516, and it is within the scope of the invention for structure 500 to be located in any desired location.

Figure 5E:
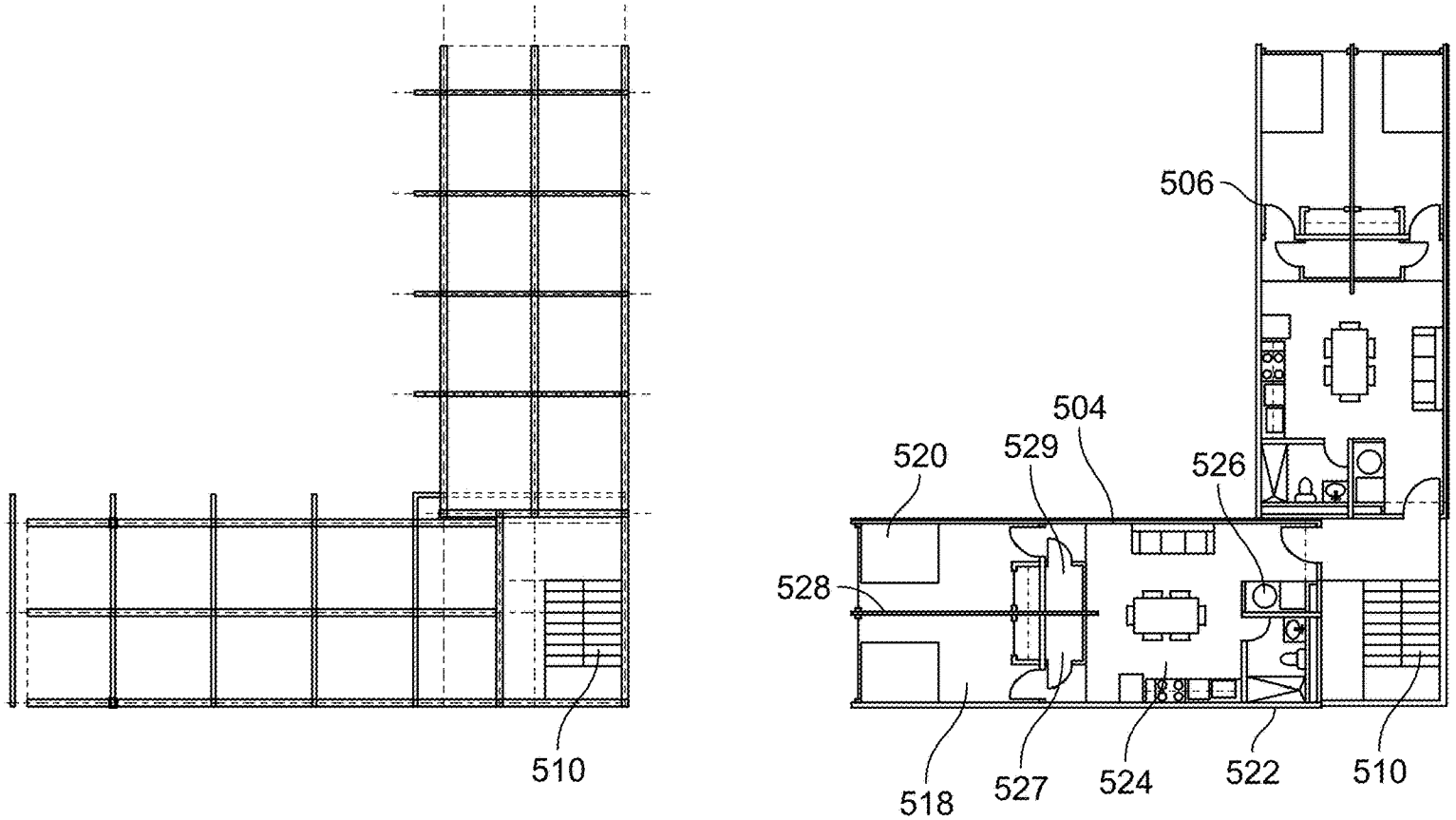
FIGS. 5E-5G show plan views of an exemplary floor layout for the structure shown in FIGS. 5A-5C.

First module 504 and second module 506 are removably supported by support assembly 502 in a substantially similar manner as the first and second modules 106 and 108 of structure 100, except that first and second modules 504 and 506 are slightly wider than first and second modules 106 and 108 to provide more space for an occupant. Referring to FIG. 5E, an exemplary floor layout of first module 504 includes a first bedroom 518, second bedroom 520, bathroom 522, kitchen/living/dining area 524, utility area 526, a first closet 527, and a second closet 529. A dividing wall 528 is positioned between the first and second bedrooms 518 and 520. An exemplary floor layout of second module 506 is substantially similar to the floor layout of first module 504 and thus is not described in detail herein.

Figure 5F:
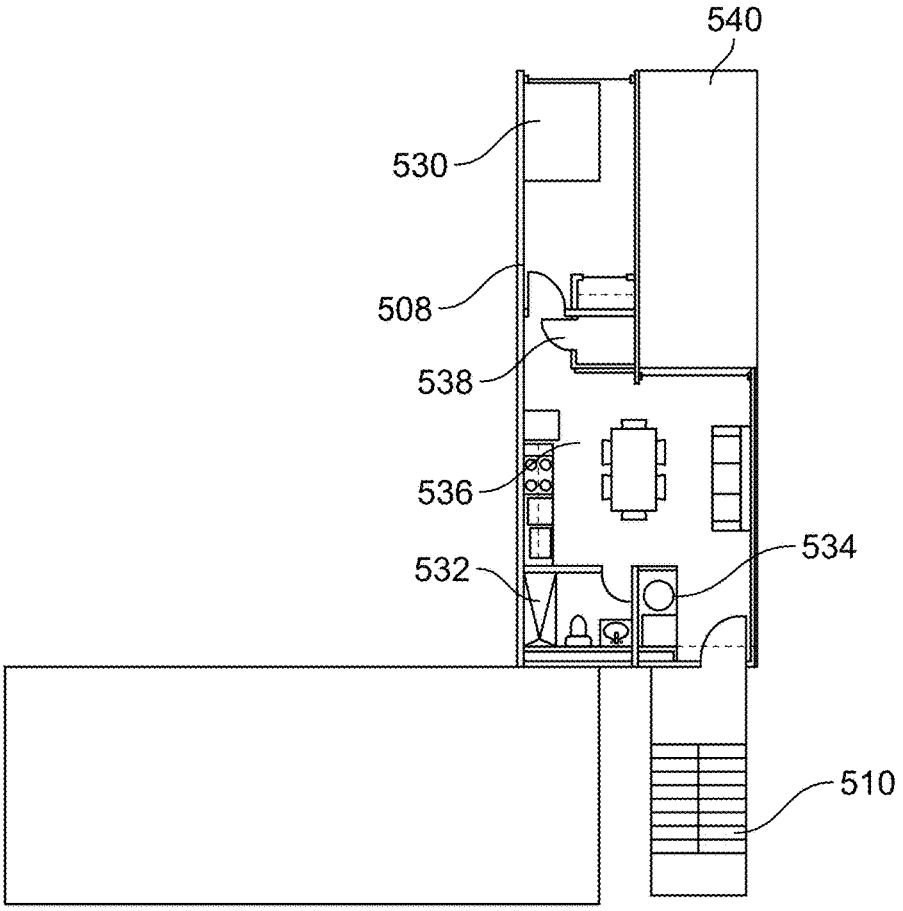

Third module 508 is removably supported by an upper surface of second module 506 in a similar manner as described above with respect to structure 200. Referring to FIG. 5F, an exemplary floor layout of third module 508 includes a bedroom 530, bathroom 532, utility area 534, kitchen/living/dining area 536, closet 538, and balcony 540.

Access system 510 has a substantially similar structure and function as access system 314 described above. Thus, access system 510 is not described in detail herein.

Figure 5G:
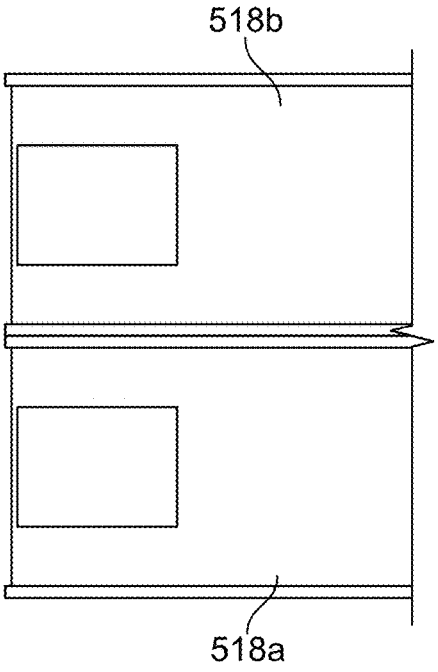

FIG. 5G shows an alternative floor layout of first and second bedrooms 518*a* and 518*b* that may be substituted for first and second bedrooms 518 and 520. First and second bedrooms 518*a* and 518*b* are slightly wider than the first and second bedrooms 518 and 520 so that a queen size bed may be positioned in each of bedrooms 518*a* and 518*b* with two and a half feet of space on each side of the bed.

FIGS. 7A-7E show alternative placements for any of structures 10, 100, 200, 300, 400, 500, and 800 within a parking lot 600, parking lot 602, and parking lot 604. Note that while the building shapes and sizes shown in FIGS. 7A-7E may differ from the shapes and sizes of structures 10, 100, 200, 300, 400, 500, and 800 shown in FIGS. 1A-5G & 8A-8J, it is within the scope of the invention for the shapes and sizes of structures 10, 100, 200, 300, 400, 500, and 800 to be modified to fit within any desired space and dimensions, including those shown in FIGS. 7A-7E.

Parking lot 600 includes a center island 606 positioned between parking spaces located in the center of the parking lot 600. Stairs 608 and 610 are located on center island 606. Structures 612 and 614 are accessible via stairs 608 and 610, respectively, and are positioned above parking spaces on either side of center island 606 to utilize the space above those parking spaces while still allowing automobiles to park in the parking spaces. Parking lot includes center islands 616 and 618 positioned at either end of a row of parking spaces. Stairs 620 and 622 are located on center islands 616 and 618, respectively. Structures 624 and 626 are accessible via stairs 620 and 622, respectively, and are positioned above parking spaces between center islands 616 and 618 to utilize the space above those parking spaces while still allowing automobiles to park in the parking spaces. Parking lot 600 includes a corner section 628 that due to the configuration of parking spaces within the lot is un-utilized or underutilized space not available for parking automobiles. Stairs 630 are located in corner section 628. Structure 632 is accessible via stairs 630 and is positioned above parking spaces extending outward from both sides of corner section 628. Parking lot 600 includes a raised median 634 at the end of a row of parking spaces. Stairs 636 are located on raised median 634. Structure 638 is accessible via stairs 636 and is positioned above parking spaces adjacent raised median 634. Parking lot 600 may include one or more of the structures 612, 614, 624, 626, 632, and 638 shown in FIG. 7A. Structures 612, 614, 624, 626, 632, and 638 may have a similar configuration as any of the structures 10, 100, 200, 300, 400, 500, and 800 described herein.

Figure 7A:
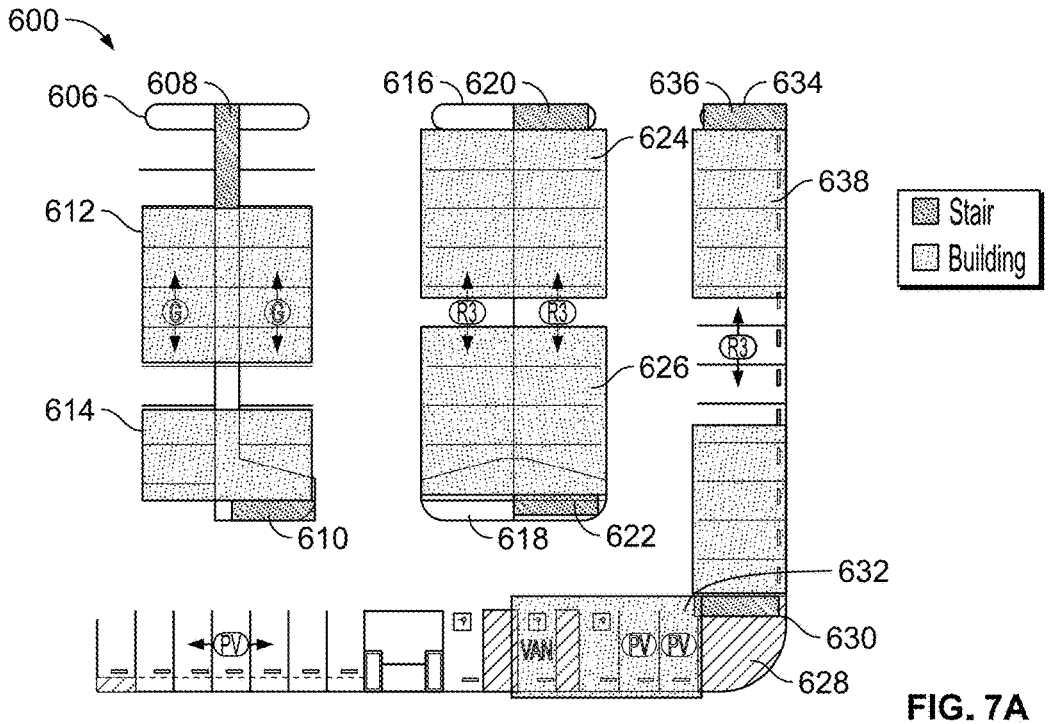
FIGS. 7A-7E show plan views of exemplary site layouts within a parking lot for structures in accordance with the invention described herein, including structures that may have above grade walkways to provide access between adjacent modules.
Figure 7B:
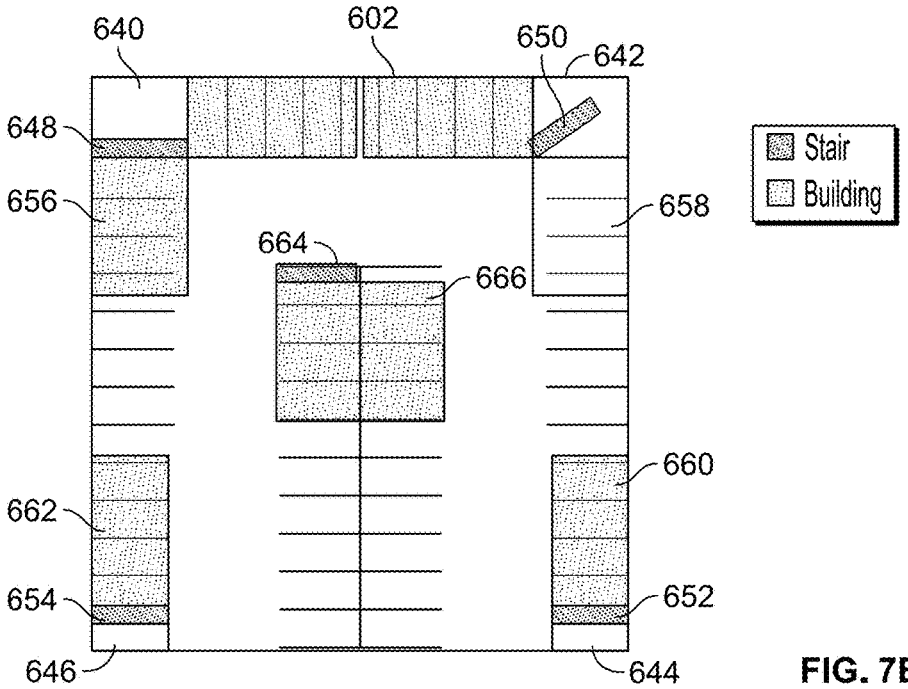
Figure 7C:
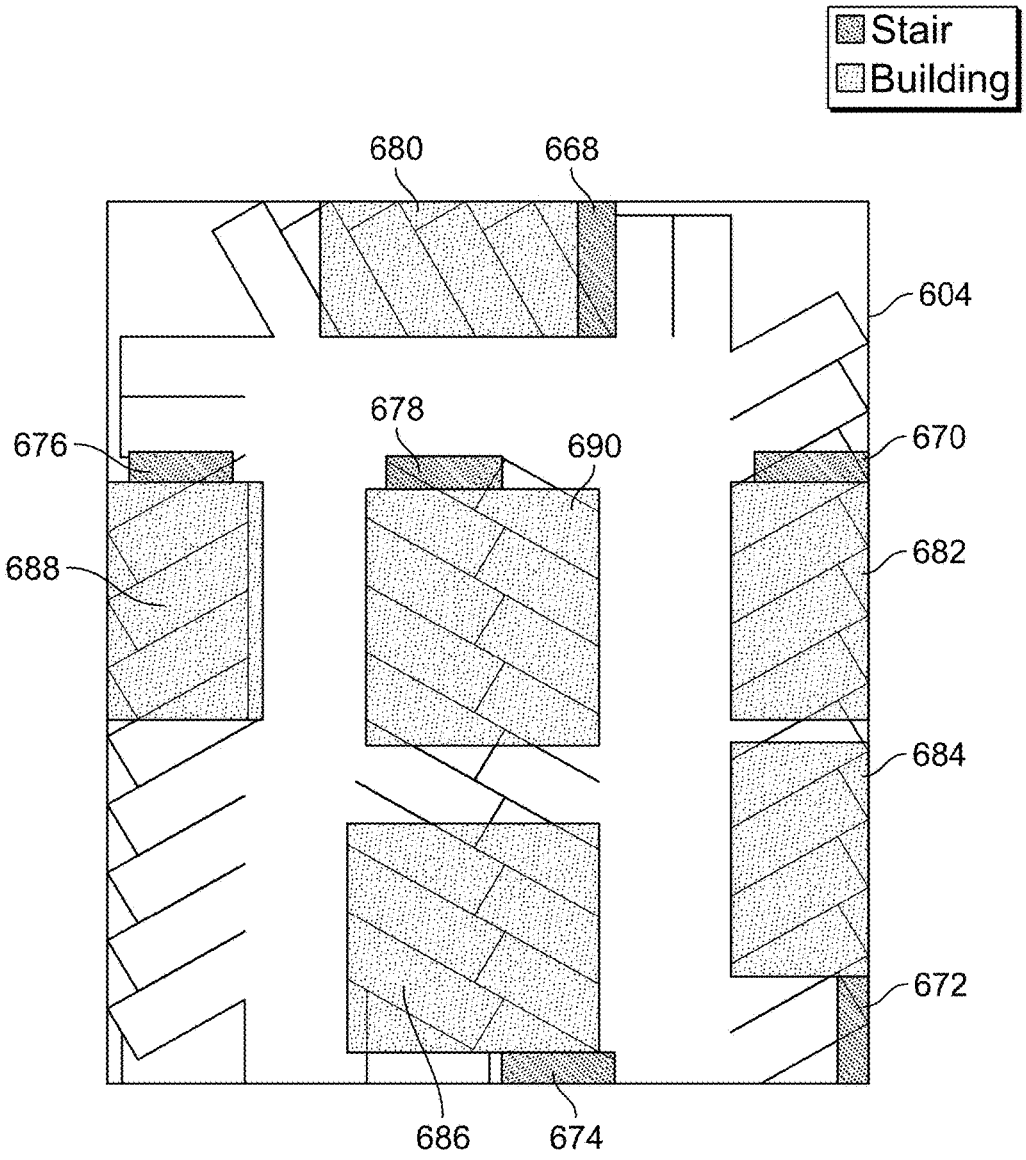
Figure 7D:
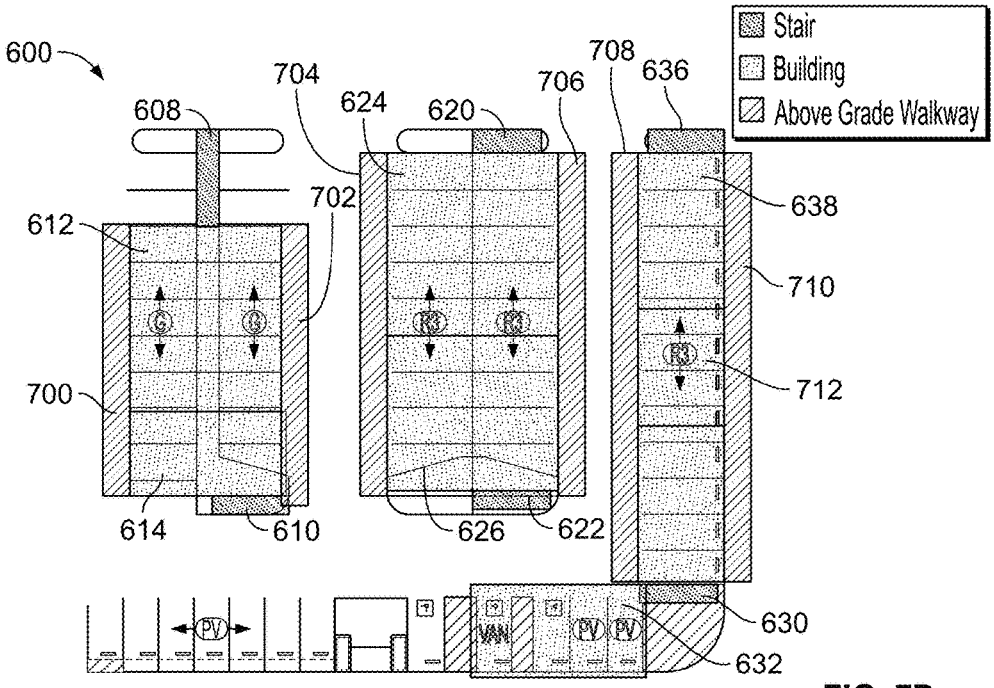
Figure 7E:
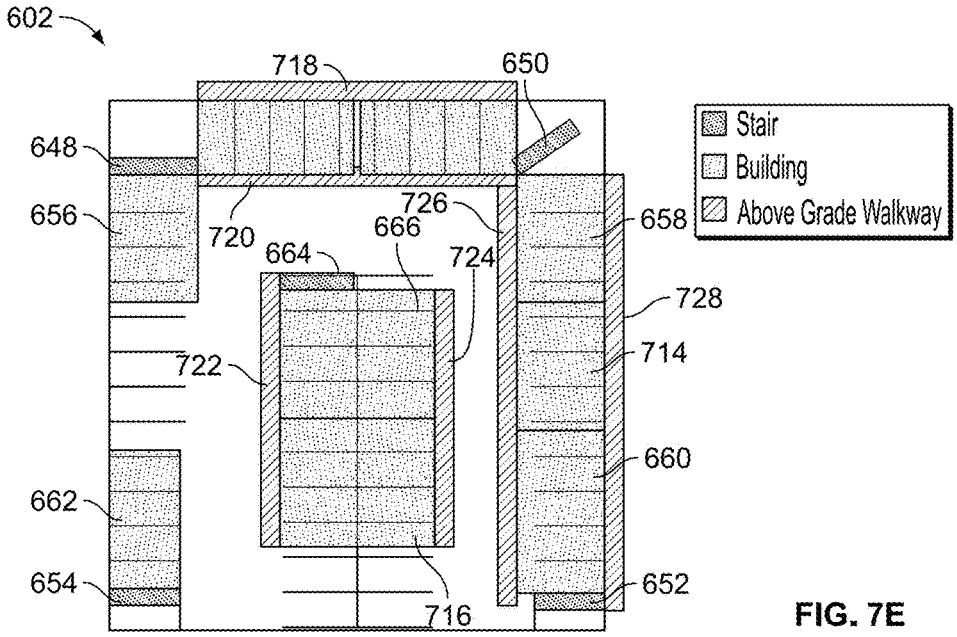

FIG. 7D shows parking lot 600 in a substantially similar configuration as shown in FIG. 7A except that above grade walkways connect certain adjacent structures 612, 614, 624, 626, 632, 638, and 712. Walkways 700 and 702 are positioned on opposite sides of, and may extend the lengths of, structures 612 and 614 and may connect exterior doors of the structures 612 and 614 to, for example, provide access to structure 612 from stairs 610. Walkways 704 and 706 are positioned on opposite sides of, and may extend the lengths of, structures 624 and 626 and may connect exterior doors of the structures 624 and 626 to, for example, provide access to structure 626 from stairs 620. Walkways 708 and 710 are positioned on opposite sides of, and may extend the lengths of, structures 632, 638, and 712 and may connect exterior doors of the structures 632, 638, and 712 to, for example, provide access to structure 712, or other modules on the same horizontal plane, from stairs 630. The walkways may be located on one or both sides of the modules. Walkways 700, 702, 704, 706, 708, and 710 are positioned above the ground level of parking lot 600 at approximately the same height as structures 612, 614, 624, 626, 632, 638, and 712 so that an automobile may drive underneath the walkways 700, 702, 704, 706, 708, and 710. The walkways 700, 702, 704, 706, 708, and 710 are preferably removably connected to at least one of the structures 612, 614, 624, 626, 632, 638, and 712 or the support assemblies (not shown) supporting the structures 612, 614, 624, 626, 632, 638, and 712 so that the walkways 700, 702, 704, 706, 708, and 710 may be removed and reused at a different site if desired. The walkways 700, 702, 704, 706, 708, and 710 preferably provide access to exterior doors of at least two of the structures 612, 614, 624, 626, 632, 638, and 712 from one of stairs 608, 610, 620, 622, 630, and 636 or from a set of stairs on the opposite side of the modules from the first stair as required by building codes and other authorities having jurisdiction.

Parking lot 602 shown in FIG. 7B includes corner sections 640, 642, 644, and 646, in which are positioned stairs 648, 650, 652, and 654, respectively. Structures 656, 658, 660, and 662 are accessible via stairs 648, 650, 652, and 654, respectively. Structures 656, 658, 660, and 662 are positioned above parking spaces adjacent corner sections 640, 642, 644, and 646, respectively, to utilize the space above those parking spaces while still allowing automobiles to park in the parking spaces. Stairs 664 are positioned at the end of a row of parking spaces positioned in the center of parking lot 602. Stairs 664 are preferably located in a position where they do not require the removal of any parking spaces within parking lot; however, they may be located in a position that utilizes un-needed or underutilized parking spaces or other pieces of land. Structure 666 is accessible via stairs 664 and is positioned above parking spaces in the center of parking lot 602. Parking lot 602 may include one or more of the structures 656, 658, 660, 662, and 666 shown in FIG. 7B. Structures 656, 658, 660, 662, and 666 may have a similar configuration as any of the structures 10, 100, 200, 300, 400, 500, and 800 described herein.

FIG. 7E shows parking lot 602 in a substantially similar configuration as shown in FIG. 7B except that above grade walkways connect certain adjacent structures 656, 658, 660, 662, 714, and 716. Walkways 718 and 720 are positioned on opposite sides of, and may extend the lengths of, portions of structures 656 and 658 and may connect exterior doors of the structures 656 and 658 to, for example, provide access to structure 658 from stairs 648 or other modules on the same horizontal plane from stairs 630. The walkways may be located on one or both sides of the modules. Walkways 722 and 724 are positioned on opposite sides of, and may extend the lengths of, structures 666 and 716 and may connect exterior doors of the structures 666 and 716 to, for example, provide access to structure 716 from stairs 664. Walkways 726 and 728 are positioned on opposite sides of, and may extend the lengths of, structures 658, 660, and 714 and may connect exterior doors of the structures 658, 660, and 714 to, for example, provide access to structure 714 from stairs 652. Walkways 718, 720, 722, 724, 726, and 728 are positioned above the ground level of parking lot 602 at approximately the same height as structures 656, 658, 660, 662, 714, and 716 so that an automobile may drive underneath the walkways 718, 720, 722, 724, 726, and 728. The walkways 718, 720, 722, 724, 726, and 728 are preferably removably connected to at least one of the structures 656, 658, 660, 662, 714, and 716 or the support assemblies (not shown) supporting the structures 656, 658, 660, 662, 714, and 716 so that the walkways 718, 720, 722, 724, 726, and 728 may be removed and reused at a different site if desired. The walkways 718, 720, 722, 724, 726, and 728 preferably provide access to exterior doors of at least two of the structures 656, 658, 660, 662, 714, and 716 from one of stairs 648, 650, 652, 654, and 664. Walkways may be positioned to allow for access to other modules on the same horizontal plane from the access stairs and/or to access other stairs or vertical transportation methods. The walkways may be located on one or both sides of the modules.

Parking lot 604 shown in FIG. 7C includes stairs 668, 670, 672, 674, 676, and 678 that are positioned in locations of parking lot 604 that are preferably unavailable for use as parking spaces due to the configuration of parking lot 604. Stairs 668, 670, 672, 674, 676, and 678 may also be positioned above a parking space in a manner that still allows for parking an automobile in the space. For example, stairs 670 are preferably positioned so that the highest point of the stairs 670 are located at the entrance to the parking space so that an automobile may pull in to the parking space and be positioned underneath the stairs 670. Structures 680, 682, 684, 686, 688, and 690 are accessible via stairs 668, 670, 672, 674, 676, and 678. Structures 680, 682, 684, 686, 688, and 690 are positioned above parking spaces within parking lot 604 to utilize the space above those parking spaces while still allowing automobiles to park in the parking spaces. Parking lot 604 may include one or more of the structures 680, 682, 684, 686, 688, and 690 shown in FIG. 7C. Structures 680, 682, 684, 686, 688, and 690 may have a similar configuration as any of the structures 10, 100, 200, 300, 400, 500, and 800 described above. Walkways may be positioned to allow for access to other modules on the same horizontal plane from the access stairs and/or to access other stairs or vertical transportation methods. The walkways may be located on one or both sides of the modules.

Figure 8A:
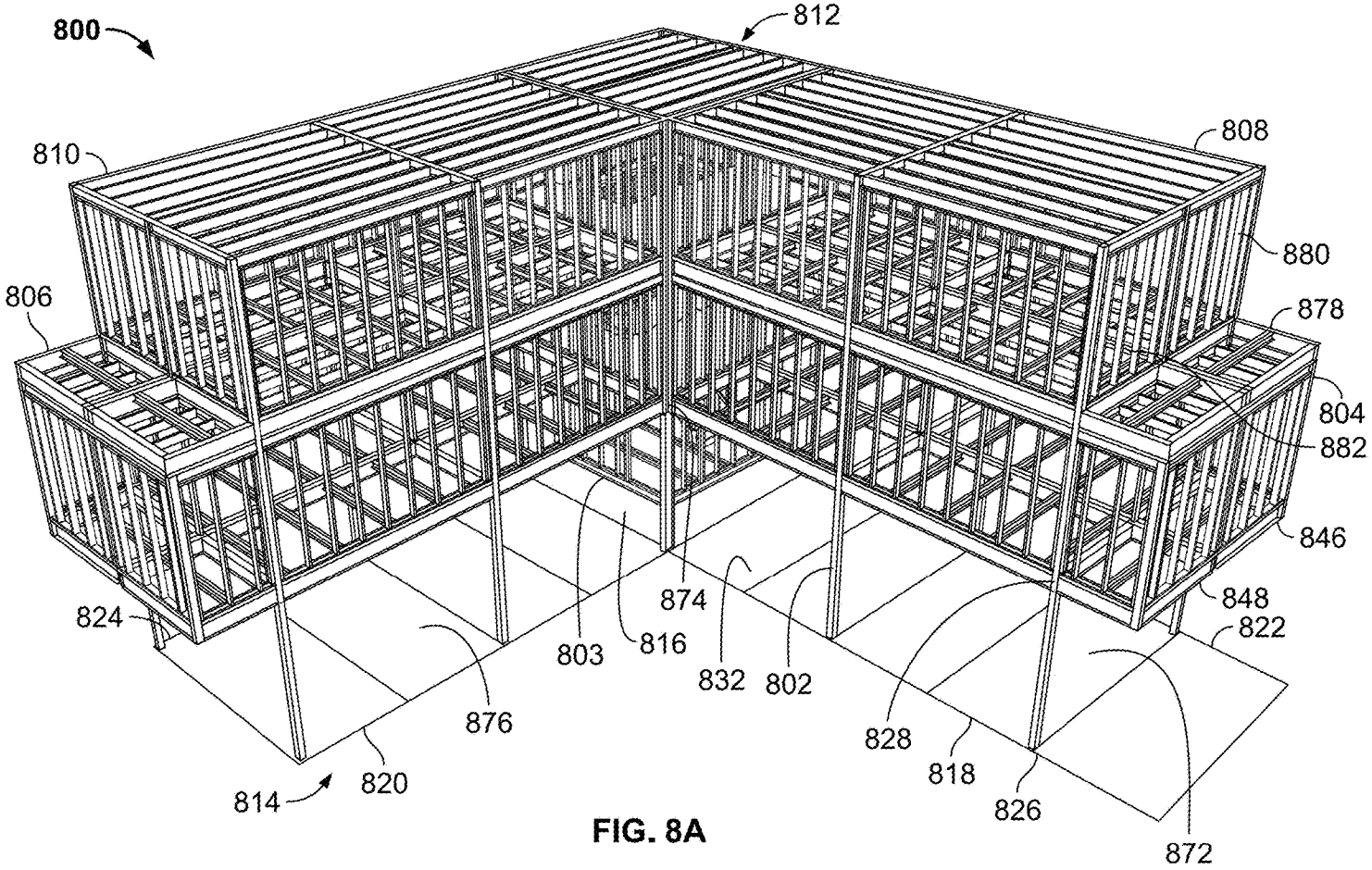
FIGS. 8A-8I show perspective views of a sixth exemplary embodiment of structure in accordance with the invention described herein.
Figure 8B:
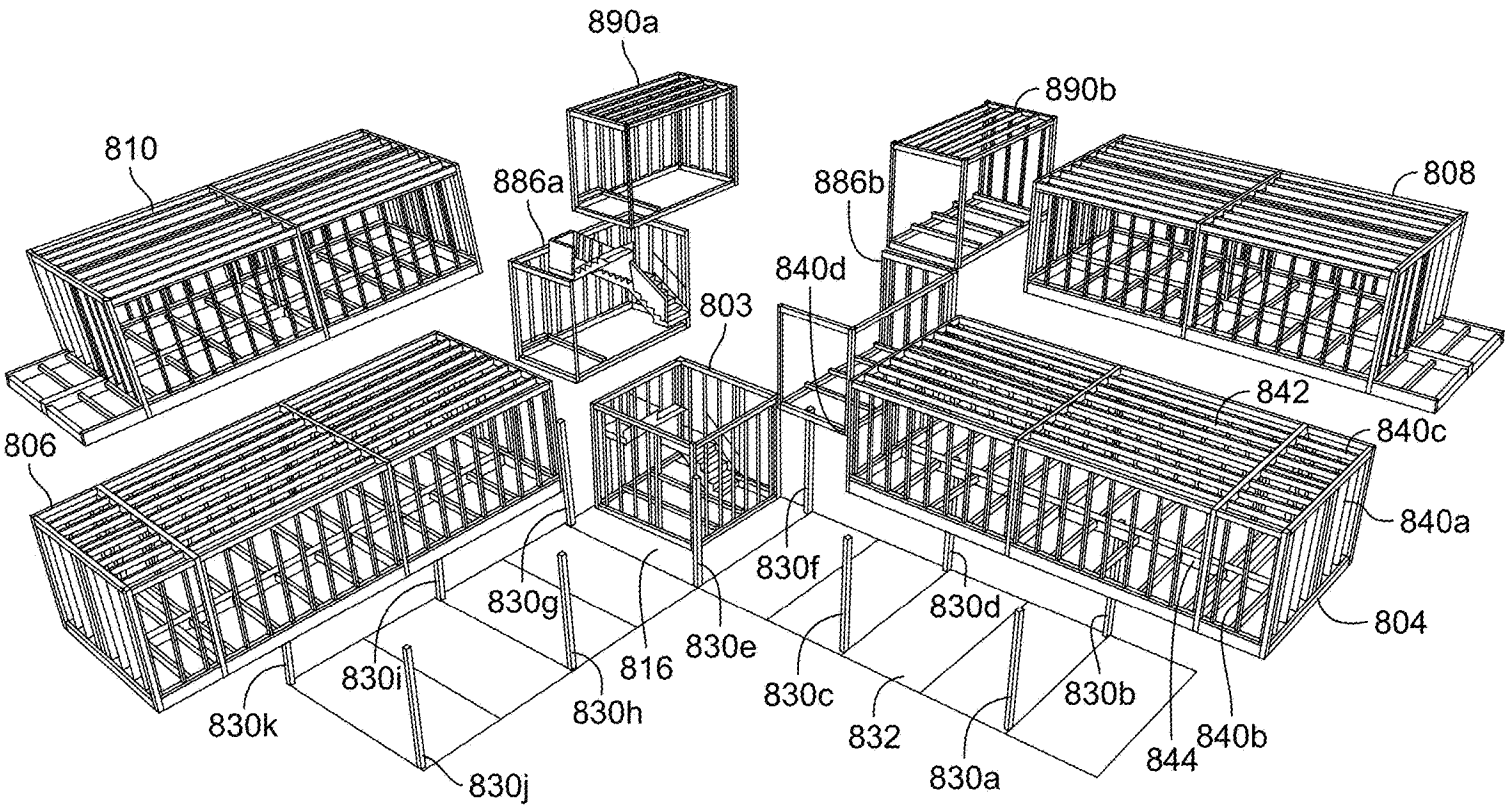

FIGS. 8A-8J show an alternative embodiment of structure 800 in accordance with the invention described herein. Structure 800 includes a support assembly 802, a ground-level enclosure 803, a first module 804, a second module 806, a third module 808, a fourth module 810, and an access system 812 (best shown in FIG. 8C). Like structure 10, structure 800 is also shown in FIG. 8A as being located in the corner of a parking lot 814, and it is within the scope of the invention for structure 800 to be located in any desired location. Specifically, ground-level enclosure 803 and access system 812 are located in a corner 816 of the parking lot 814 in an area that is conventionally un-utilized or underutilized due to the configuration of the parking spaces located in the parking lot 814. The parking lot 814 includes at least a first row of parking spaces 818 and a second row of parking spaces 820. The first row of parking spaces 818 extend laterally outward in a first direction from one side of corner 816, and the second row of parking spaces 820 extend laterally outward from another side of corner 816 in a second direction that is generally perpendicular to the first direction. The corner 816 is positioned at an end of the first row of parking spaces 818 and at an end of the second row of parking spaces 820. The first row of parking spaces 818 is oriented perpendicular to a peripheral boundary line 822 between the parking lot 814 and a sidewalk, or other piece of land, adjacent to the parking lot 814, and the second row of parking spaces 820 is oriented perpendicular to a peripheral boundary line 824 between the parking lot 814 and a sidewalk, or other piece of land. Corner 816 is un-utilized or underutilized space of parking lot 814 because it cannot be easily used to park an automobile due to the configuration of the first and second rows of parking spaces 818, 820 (i.e., if automobiles are parked in the parking spaces adjacent to corner 816, an automobile within parking lot 814 cannot access corner 816). Ground-level enclosure 803 and access system 812 are located within corner 816 so that they do not eliminate any of the parking spaces within parking lot 814. In this manner, structure 800 increases the amount of usable space within parking lot 814, by providing a ground-level enclosure 803 and first, second, third, and fourth modules 804, 806, 808, and 810, which may be used for a variety of purposes discussed herein, without eliminating or significantly detracting from the existing usage of parking lot 814 (i.e., structure 800 does not eliminate any of the existing parking spaces within parking lot 814).

Support assembly 802 supports and elevates first, second, third, and fourth modules 804, 806, 808, and 810 above the ground level of parking lot 814. Support assembly 802 includes a lower surface 826 that is supported by the ground 832 and an upper surface 828, which is spaced above lower surface 826 and supports first and second modules 804 and 806. Support assembly 802 includes spaced apart columns 830*a-k* (FIG. 8B) that are suitably designed, constructed, and installed to support first and second modules 804 and 806. Columns 830*a*, 830*c*, 830*h*, and 830*j* are preferably positioned between parking spaces within the parking lot 814. Columns 830*e*, 830*f*, and 830*g* are positioned in corner 816. Columns 830*a-d* are spaced from columns 830*e* and 830*f* in a direction aligned with the direction that first row of parking spaces 818 extends away from corner 816. Columns 830*h-k* are spaced from columns 830*e* and 830*g* in a direction aligned with the direction that second row of parking spaces 820 extends away from corner 816. The lower surface 826 (FIG. 8A) of support assembly 802 is formed by the combination of the lower surfaces of columns 830*a-k*, and the upper surface 828 (FIG. 8A) of support assembly 802 is formed by the combination of the upper surfaces of columns 830*a-k*. The support assembly 802 does not cover the ground 832 beneath first and second modules 804 and 806. The ground 832 remains uncovered so that automobiles may directly park on the ground 832 beneath first and second modules 804 and 806 between columns 830*a-k*. Thus, no portion of structure 800 covers the existing ground surface on which automobiles park.

Figure 8C:
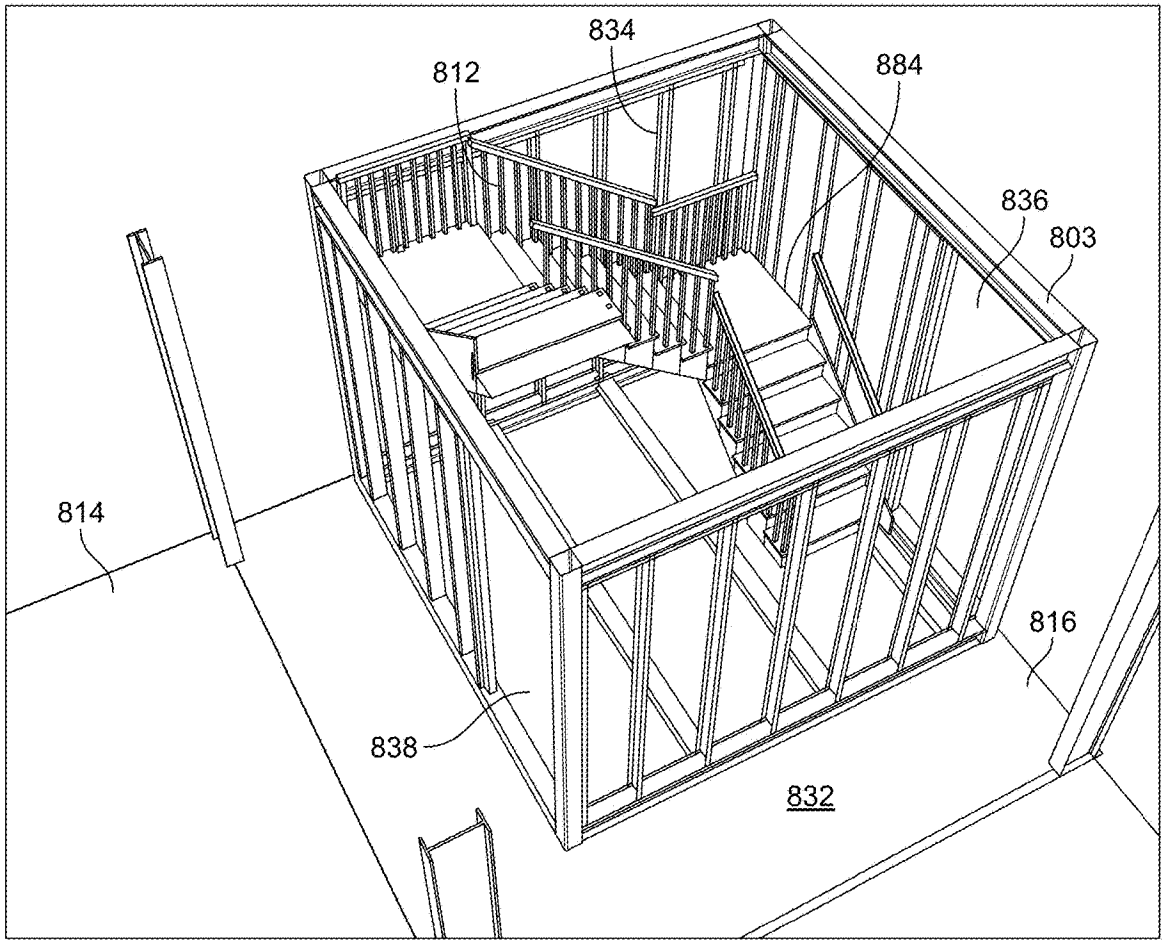

Ground-level enclosure 803, shown in FIG. 8C, is supported by the ground 832 in the corner 816 of parking lot 814. Ground-level enclosure 803 includes four walls, one of which is identified as, 834 that enclose an interior space that contains a portion of access system 812, as described in more detail below. Openings 836 and 838 provide access to the interior space within ground-level enclosure 803. Ground-level enclosure 803 may be used for any of the purposes described above in connection with ground-level enclosure 13, or omitted from structure 800.

Figure 8D:
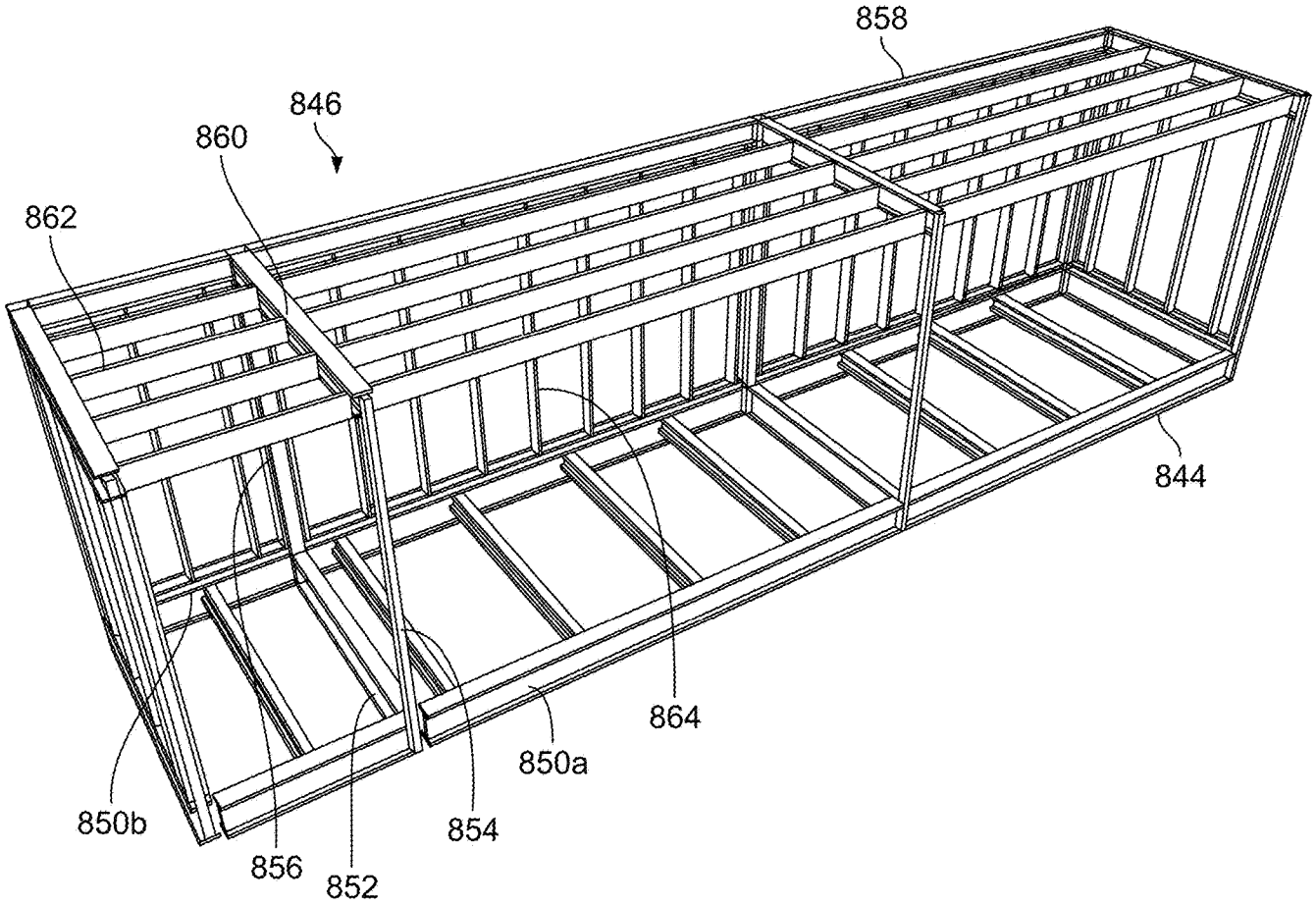
Figure 8E:
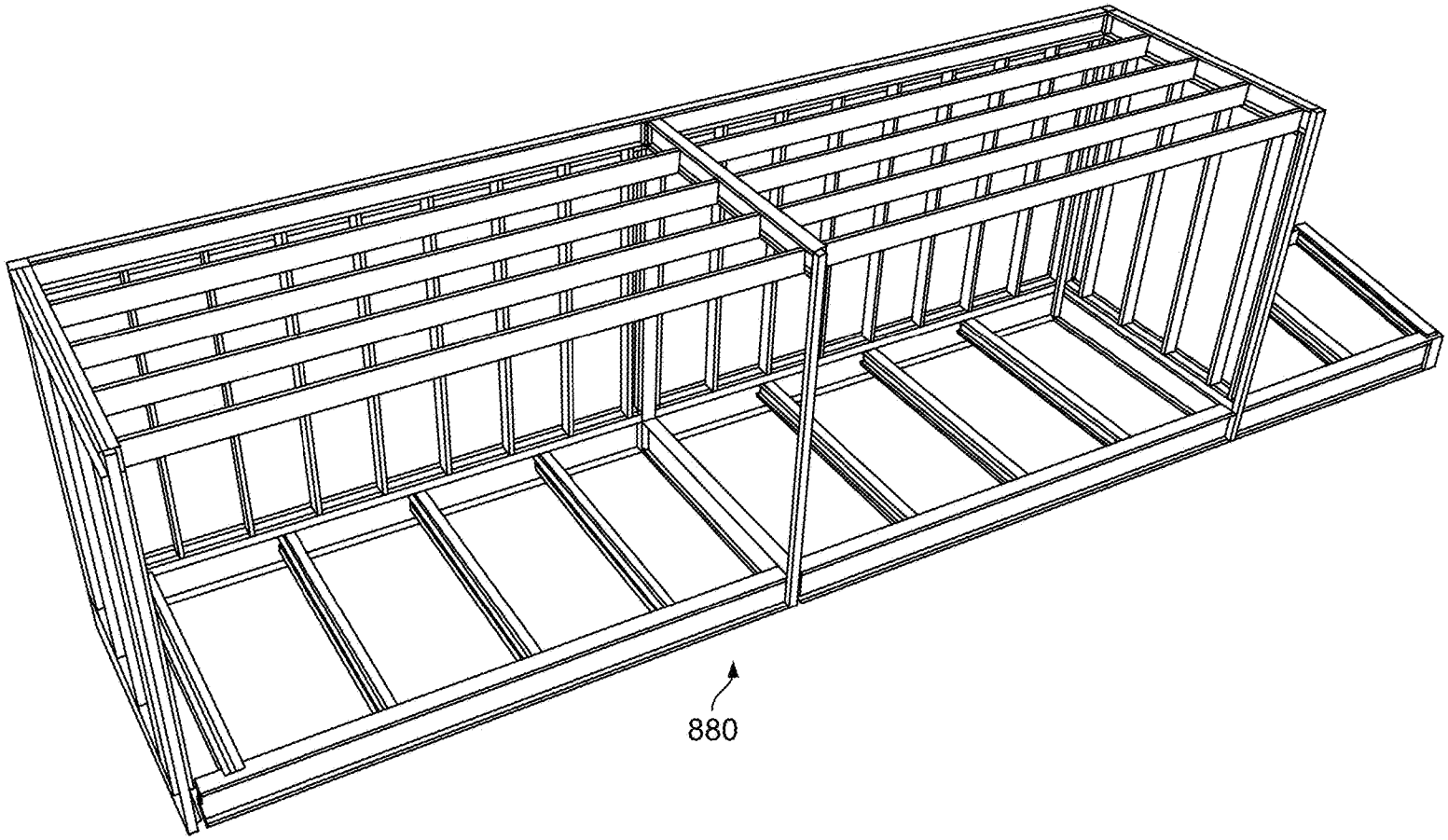
Figure 8F:
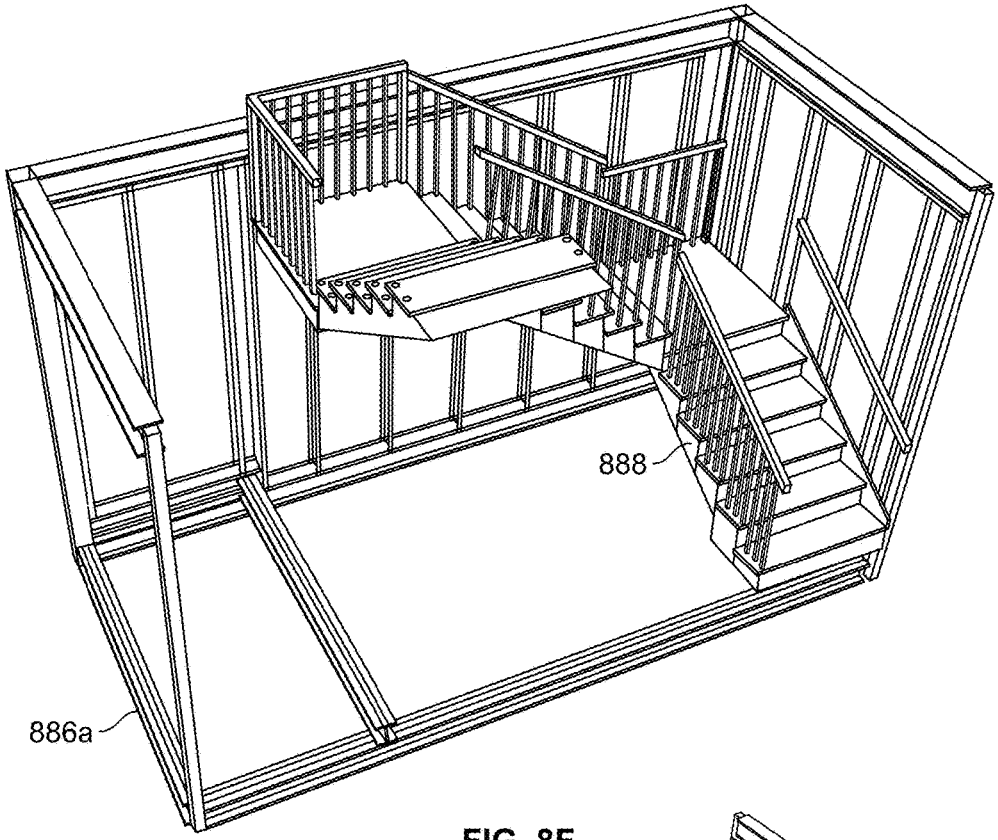
Figure 8G:
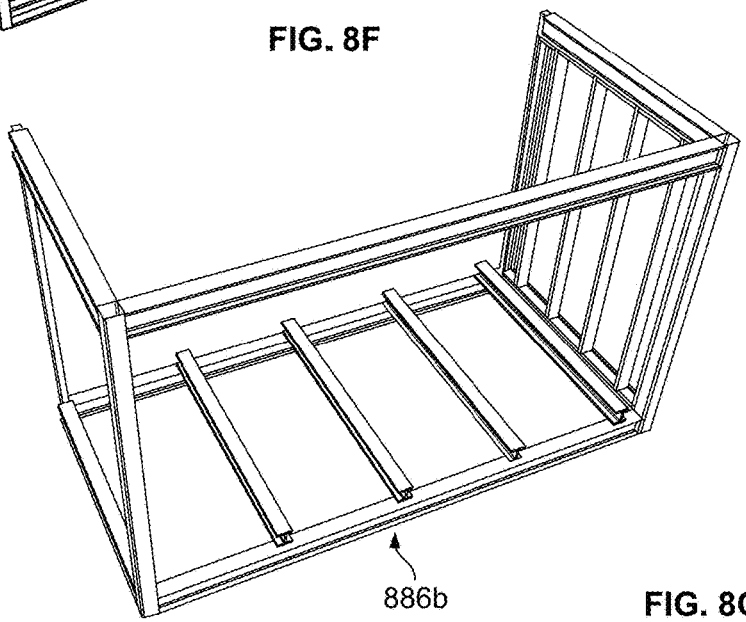
Figure 8H:
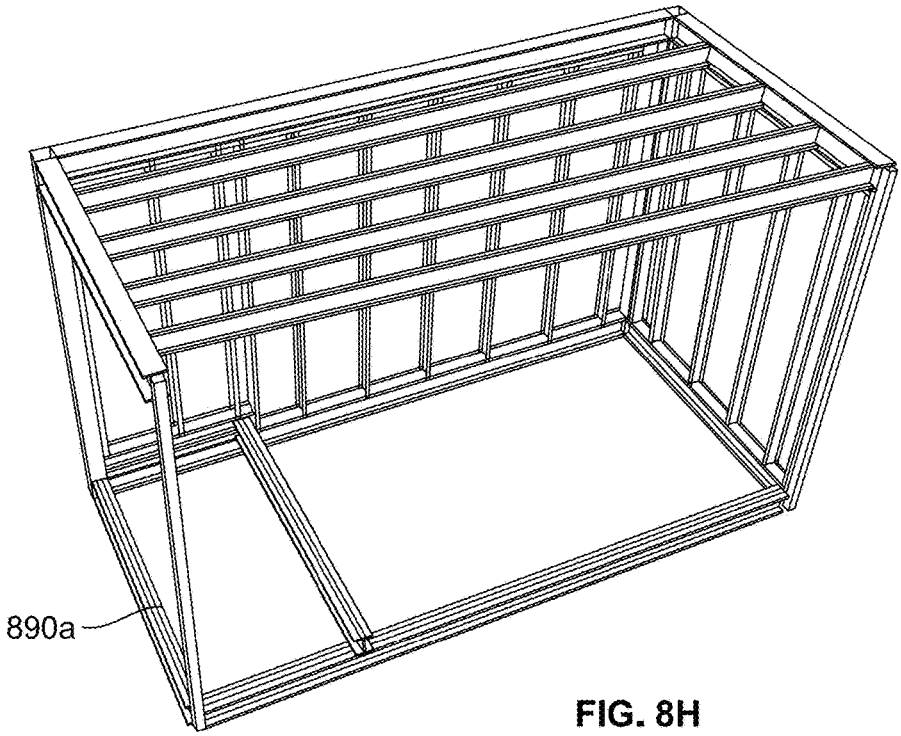
Figure 8I:
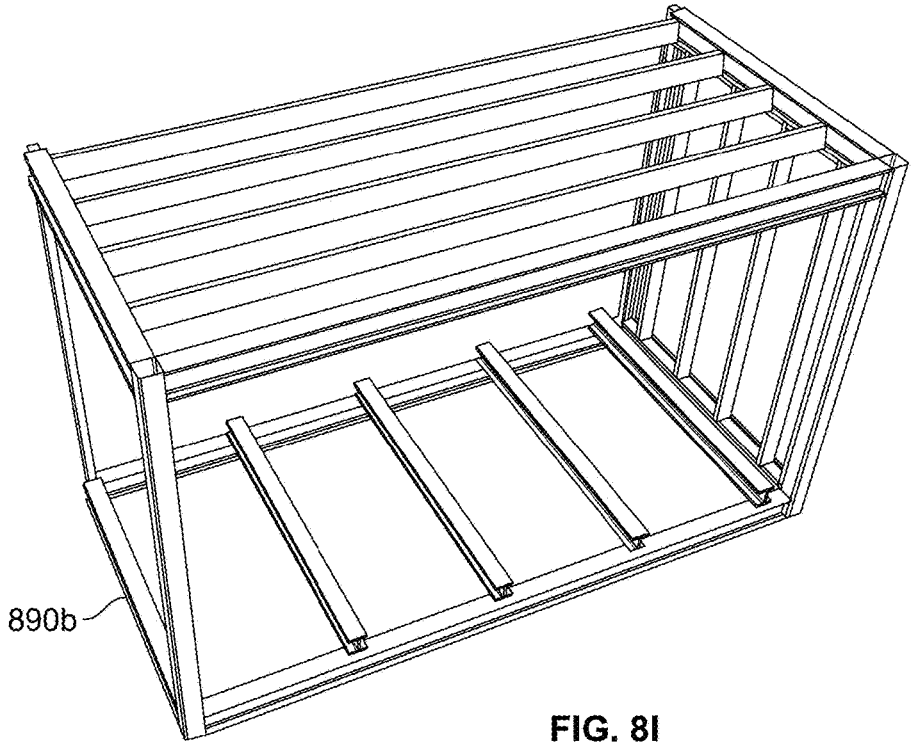
Figure 8J:
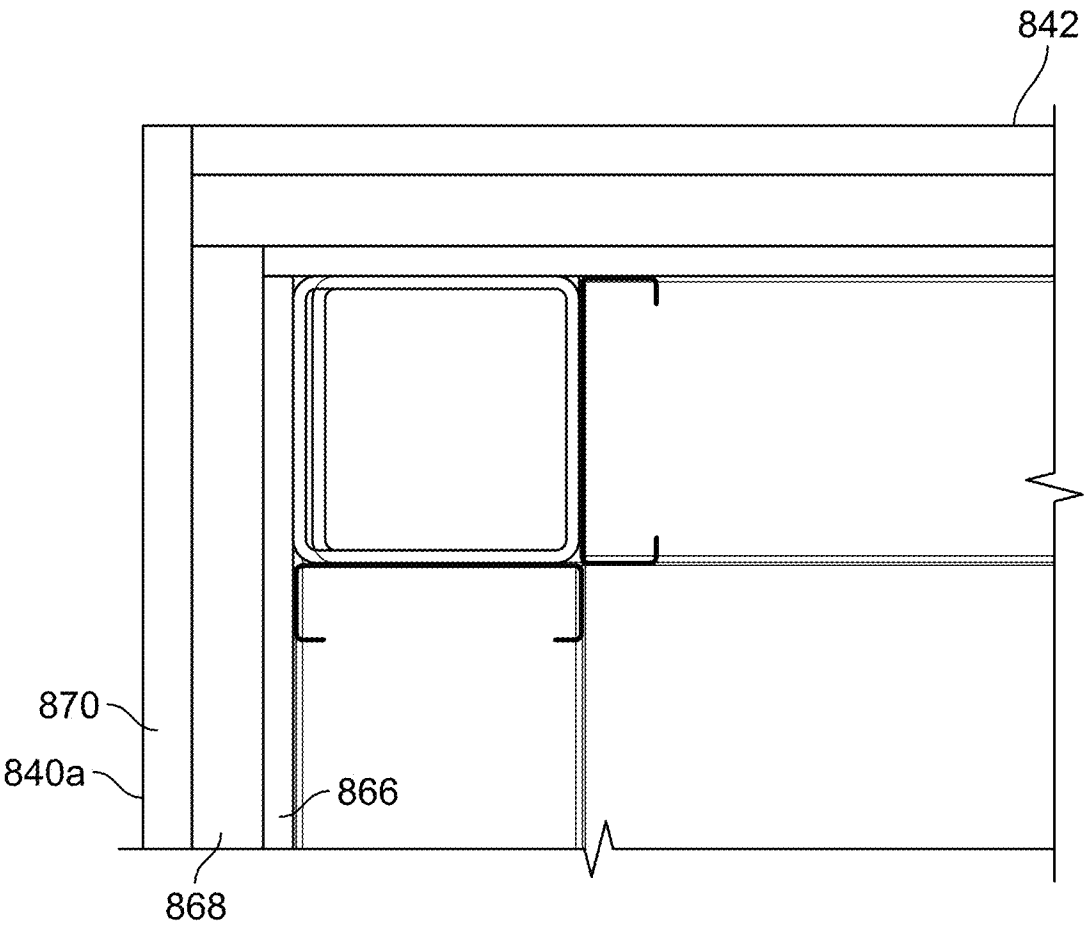
FIG. 8J shows a cross-sectional view of a portion of the structure shown in FIGS. 8A-8I.

First module 804 is preferably a pre-assembled building or unit, the structure of which consists primarily of four walls 840*a-d* (FIG. 8B), a roof 842, and a floor 844 that are joined to enclose an interior space. Floor 844 abuts and is supported by the upper surfaces of columns 830*a-f*. First module 804 is formed from two sub-modules 846 and 848 (FIG. 8A) that are substantially mirror images of each other and joined together. Referring to FIG. 8D, floor 844 of sub-module 846 includes two longitudinal floor beams 850*a-b* and a plurality of cross-braces, one of which is identified as 852, extending between and joined to floor beams 850*a-b*. Floor beam 850*a* is connected to a floor beam (not shown in FIG. 8D) of sub-module 848. A plurality of posts, one of which is identified as 854, extend upward from and are joined to floor beam 850*a*, and a plurality of posts, one of which is identified as 856, extend upward from and are joined to floor beam 850*b*. A longitudinal roof beam 858 is supported by and joined to posts 856 above floor beam 850*b*. Roof cross-braces, one of which is identified as 860, each extend between and are joined to spaced apart posts 854 and 856. Horizontal joists, one of which is identified as 862, extend between and are joined to adjacent roof cross-braces 860. Vertical studs, one of which is identified as 864, extend between and are joined to beams 850*b* and 858. Insulation and wall finishing materials may be joined to joists 862 and studs 864 to suitably enclose first module 804. For example, FIG. 8J shows a partial cross-sectional view of wall 840*a* and roof 842 with exemplary finishing materials. Sheating 866, such as a fiberglass mat gypsum sheathing, insulation 868, such as foam insulation, and exterior wall panels 870 may be joined to joists 862 and studs 864 to enclose first module 804. Interior panels, such as drywall, may be joined to joists 862 and studs 864 within first module 804.

The interior space enclosed by the walls 840*a-d* (FIG. 8B), roof 842, and floor 844 is accessible through an opening in wall 840*d*. Any type of floor plan, including those described above, may be used for first module 804. First module 804 is preferably pre-assembled at a location remote from where it is installed, transported to the location of install, and then lifted on top of support assembly 802 by a crane or other lifting apparatus. First module 804 may be lifted and placed on top of the support assembly 802 in one piece or in multiple sections that are each individually lifted and placed on the support assembly 802. First module 804 is then preferably removably connected to support assembly 802, such that first module 804 is removably supported by support assembly 802 in the same manner as described above with respect to module 14.

An end of first module 804 formed by wall 840*d* is positioned adjacent access system 812, which is positioned in the corner 816 of parking lot 814. First module 804 extends from wall 840*d* to wall 840*a* laterally outward from access system 812. First module 804 is positioned above the first row of parking spaces 818. First module 804 is spaced above the ground 832 forming the first row of parking spaces 818 a distance sufficient to allow an automobile to park in an accessible volume of space 872 (FIG. 8A) beneath first module 804.

Second module 806 is substantially similar to first module 804 but is supported by columns 830*e* and 830*g-k* (FIG. 8B) above second row of parking spaces 820. An end 874 (FIG. 8A) of second module 806 is positioned adjacent access system 812 and includes an opening for accessing the interior space enclosed by the module. Second module 806 extends laterally outward from access system 812 toward columns 830*j-k*. Second module 806 is spaced above the ground 832 forming the second row of parking spaces 820 a distance sufficient to allow an automobile to park in an accessible volume of space 876 (FIG. 8A) beneath second module 806. Second module 806 extends laterally outward from access system 812 in a direction that is generally perpendicular to the direction that first module 804 extends laterally outward from access system 812, such that first module 804 and second module 806 are generally perpendicular to each other. Second module 806 is preferably removably connected to and installed upon support assembly 802, such that second module 806 is removably supported by support assembly 802 in the same manner as described above with respect to module 14. First and second modules 804 and 806 may be removably joined to support assembly 802 in a similar manner as described above with respect to connector 70 shown in FIG. 6C.

Third and fourth modules 808 and 810 are positioned on top of, and removably supported by, upper surfaces of first and second modules 804 and 806, respectively. Third and fourth modules 808 and 810 are preferably not permanently joined to first and second modules 804 and 806 so that they may be lifted off, slid off, or otherwise removed off of first and second modules 804 and 806 in a manner similar to as described above with respect to lifting module 14 off of support assembly 12. Third and fourth modules 808 and 810 may be removably joined to first and second modules 804 and 806 in a similar manner as described above with respect to the connector 74 shown in FIG. 6C. Third and fourth modules 808 and 810 include openings adjacent access system 812 for access to the interior space enclosed by the modules.

Third module 808 has a similar structure as first module 804 described above except that third module 808 includes an unenclosed area 878 (FIG. 8A), which may be used for a balcony. Like first module 804, third module 808 is formed from two sub-modules 880 and 882 that are substantially mirror images of each other and joined together. Sub-module 880 is shown in FIG. 8E. Sub-module 880 is formed from floor beams, floor cross-braces, posts, roof beams, roof cross-braces, joists, and studs in a similar manner as sub-module 846 described above and shown in FIG. 8D. Accordingly, sub-module 880 is not described in detail herein. Fourth module 810 is a mirror image of third module 808 and is thus not described in detail herein.

First and second modules 804 and 806 preferably include similar utility and inter-module utility connections as described above in connection with module 14. Third and fourth modules 808 and 810 preferably access utilities from first and second modules 804 and 806 with utility connections of third and fourth modules 808 and 810 that are releasably connected to inter-module utility connections of first and second modules 804 and 806, as described above. The utility lines of the first, second, third, and fourth modules 804, 806, 808, and 810 may be positioned within hollow cavities of the vertical posts forming the structure of the modules. For example, post 854 (FIG. 8D) may be substantially hollow so that utility lines may be positioned within the post. Plumbing lines may be positioned within vertical posts on one side of the modules and electrical lines may be positioned within vertical posts on the other side of the modules. Utility connections may be positioned at the bottom of post 854 for connecting to utilities located at the site. Inter-module utility connections may be positioned at the top of post 854 for connecting to the utility connections of third module 808. Columns 830*a-k* of support assembly 802 may also be substantially hollow so that they may contain utility lines extending upward from the ground 832 to the first and second modules 804 and 806.

Access system 812 may be constructed from any of the components described above, and by any of the methods described above, in connection with access system 16. Further, access system 812 may be used for any of the purposes described above in connection with access system 16, and include any of the alternative features described above in connection with access system 16. Only the differences between access system 812 and access system 16 are described in detail herein. Access system 812 is configured to allow a person on the ground 832, or adjacent the lower surface 826 of support assembly 802 to move vertically upward adjacent the upper surface 828 of support assembly 802 to a position where the person may access the doors or openings of first, second, third, and fourth modules 804, 806, 808, and 810. Access system includes a first set of stairs 884, shown in FIG. 8C, that extends upward from the ground to a first stair landing, which is formed from joining the sub-modules 886*a* and 886*b* shown in FIGS. 8F and 8G. A second set of stairs 888, shown in FIG. 8F, extends upward from the first stair landing to a second stair landing, which is formed from joining the sub-modules 890*a* and 890*b* shown in FIGS. 8H and 8I. The first stair landing is at the same level as the doors or openings of first and second modules 804 and 806 so that a person on the first stair landing may access the interior spaces of first and second modules 804 and 806. The second stair landing is at the same level as the doors or openings of third and fourth modules 808 and 810 so that a person on the second stair landing may access the interior spaces of third and fourth modules 808 and 810.

The first set of stairs 884 shown in FIG. 8C may be supported by the ground 832, ground-level enclosure 803 and first stair landing sub-modules 886*a-b*. The second set of stairs 888 shown in FIG. 8F may be supported by the first stair landing sub-modules 886*a-b* and the second stair landing sub-modules 890*a-b*. The access system 812, including the first and second sets of stairs 884 and 888, the first stair landing sub-modules 886*a-b* and the second stair landing sub-modules 890*a-b*, is entirely positioned in the corner 816 of parking lot 814 so that it does not eliminate any of the parking spaces within the parking lot 814. The ground-level enclosure 803, first stair landing sub-modules 886*a-b*, and second stair landing sub-modules 890*a-b* are formed from floor beams, cross-braces, posts, roof beams, roof cross-braces, joists, and studs in a similar manner as sub-module 846 described above and shown in FIG. 8D. The first stair landing sub-modules 886*a-b* are positioned above and removably supported by the ground-level enclosure 803, and the second stair landing sub-modules 890*a-b* are positioned above and removably supported by the first stair landing sub-modules 886*a-b*.

In addition to including stairs, access system 812, and any of the other access systems disclosed herein, may include an elevator (not shown) to transport individuals between the different levels of structure 800.

Support assembly 802, ground-level enclosure 803, first module 804, second module 806, third module 808, fourth module 810, and access system 812 are preferably removably connected to each other using any of the connection methods and structures described above in connection with the other structures disclosed herein.

Structure 800 may include additional modules placed on top of third and fourth modules 808 and 810 and additional modules placed end-to-end with first, second, third, and/or fourth modules 804, 806, 808, and 810. Further, structure 800 may include above ground walkways that provide access between adjacent modules and access system 812. The above ground walkways may be external (i.e., positioned outside of the exterior walls of the modules) or internal (i.e., positioned within the exterior walls of the modules or covered, partially enclosed, or fully enclosed in some manner). FIGS. 7D-E described above show examples of walkways that may be used with structure 800.

The modules of structure 800, and the other structures disclosed herein, may be formed from preassembled walls, floors, and roofs that are stored and shipped stacked together. For example, referring to FIG. 8B, each of the walls 840*a-d*, roof 842, and floor 844 may be assembled separately from each other and then stacked together for storage and shipment to an installation location. The walls 840*a-d*, roof 842, and floor 844 are stacked together to minimize the volume taken up by the components. For example, the walls 840*b-c* may be stacked side-to-side with the roof 842 and the floor 844, which are each rotated 90 degrees from the position shown in FIG. 8B so that they abut a side of the walls 840*b-c*. The walls 840*a* and 840*d* may be stacked end-to-end with each other and in combination together side-to-side with the walls 840*b-c*, roof 842 and floor 844. The stacked together walls 840*a-d*, roof 842, and floor 844 may be bound together for shipment and storage or placed within a suitable sized shipping container. Utility connections and lines may be preinstalled within the walls 840*a-d* before they are stored and shipped. Further, the finishing materials shown in FIG. 8J may be preinstalled on the walls 840*a-d*, roof 842, and floor 844 before they are stored and shipped. After reaching an installation site, the walls 840*a-d*, roof 842, and floor 844 may be unbound and assembled into first module 804, which is then lifted on top of support assembly 802.

A method for increasing usable space in accordance with the invention described herein includes installing at least one of structures 10, 100, 200, 300, 400, 500, and 800 at a site where it is desired to increase usable space. The structure(s) 10, 100, 200, 300, 400, 500, and 800 are preferably installed at a location without detracting from the current use at the site as discussed above. Further, the structure(s) 10, 100, 200, 300, 400, 500, and 800 may be installed at any of the exemplary types of sites discussed above. With reference to structure 10, shown in FIG. 1A, the structure 10 is preferably installed by first erecting support assembly 12 and joining it to the ground. Ground-level enclosure 13 and access system 16 may then be erected around a portion of support assembly 12 on a portion of the site that is preferably un-utilized or underutilized, as discussed above. Module 14 is then lifted by a crane or other hoisting mechanism and set down on support assembly 12 and ground-level enclosure 13. Module 14 may be lifted and placed on top of the support assembly 12 in one piece or in multiple sections that are each individually lifted and placed on the support assembly 12. Module 14 is preferably removably joined to support assembly 12 as discussed above. Any utility connections of module 14 may then be connected to utilities available at the site, as discussed above. The space within module 14 may then be rented or sold for any of the purposes discussed above.

Structures 100, 200, 300, 400, 500, and 800 are installed at a site in a similar manner as structure 10, except that for those structures 200, 300, 400, 500, and 800 with multiple levels of modules, the upper levels of modules are lifted and set down on lower levels of modules instead of being supported directly by a support assembly. The upper levels of modules are removably joined to the lower levels of modules and any desired utility connections are made between the inter-module utility connections of the lower levels of modules and the utility connections of the upper levels of modules, as discussed above.

If it is desired to remove one of the structures 10, 100, 200, 300, 400, 500, and 800 from the site on which it is installed, for example to develop the site with a larger building, any utility connections are first disconnected. With reference to structure 10 in FIG. 1A, any connectors joining module 14 to support assembly 12 are disconnected or removed, and module 14 is lifted off of support assembly 12 with a crane or other hoisting mechanism. Module 14 may be set on a trailer for hauling to a new installation site. Ground-level enclosure 13 and access system 16 are preferably then deconstructed, if necessary, and removed from the site. Support assembly 12 is then preferably deconstructed, if necessary, and removed from the site. Support assembly 12, ground-level enclosure 13, module 14, and access system 16 are preferably reusable and may be transported to a new location for installation.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A method for increasing usable space in a parking lot comprising a plurality of parking spaces, the method comprising:

erecting a support assembly in the parking lot, wherein a first portion of the support assembly is positioned in an underutilized space of the parking lot, wherein the underutilized space is not available for parking an automobile, and wherein the underutilized space is selected from the group consisting of an island, a median, and a corner section, wherein a second portion of the support assembly is positioned between a first parking space and a second parking space of the plurality of parking spaces, and wherein the support assembly comprises an upper surface spaced above a lower surface;

erecting an access system in the parking lot, wherein the access system is positioned in the underutilized space, and wherein the access system is configured to allow a person adjacent the lower surface of the support assembly to move vertically upward adjacent the upper surface of the support assembly;

lifting a module, wherein the module at least partially encloses an interior space accessible through an opening in the module;

placing the module on top of the support assembly so that the module is supported by the upper surface of the support assembly, the module extends laterally outward from the access system, the module is positioned above at least one of the first parking space and the second parking space, and there is an accessible volume of space positioned below the module that is sufficient to permit an automobile to park in the at least one of the first parking space and the second parking space; and removably connecting the module to the support assembly with one or more connectors so that the module is not permanently joined to the support assembly and the module may be disconnected from the support assembly and lifted off of the support assembly.

2. The method of claim 1, further comprising disconnecting the module from the support assembly, and lifting the module off of the support assembly.

3. The method of claim 2, further comprising after lifting the module off of the support assembly, transporting the module to a new location for installation.

4. The method of claim 1, wherein the parking lot comprises a first peripheral boundary line that intersects a second peripheral boundary line, wherein the plurality of parking spaces comprises a first row of parking spaces adjacent the first boundary line and a second row of parking spaces adjacent the second boundary line, and wherein the underutilized space comprises a corner section of the parking lot that is positioned between the first row of parking spaces and the second row of parking spaces.

5. The method of claim 1, further comprising:

lifting a second module, wherein the second module at least partially encloses a second interior space accessible through a second opening in the second module; and placing the second module on top of the support assembly so that the second module is supported by the upper surface of the support assembly, the second module extends laterally outward from the access system, the second module is positioned above at least one of the plurality of parking spaces, and there is an accessible volume of space positioned below the second module that is sufficient to permit an automobile to park in the at least one of the plurality of parking spaces.

6. The method of claim 5, wherein the module and the second module are generally perpendicular to each other, wherein the access system is positioned adjacent an end of the module, and wherein the access system is positioned adjacent an end of the second module.

7. The method of claim 1, further comprising:

lifting a second module, wherein the second module at least partially encloses a second interior space accessible through a second opening in the second module; and placing the second module on top of the module.

8. The method of claim 7, further comprising releasably coupling an inter-module utility connection of the module with a utility connection of the second module.

9. The method of claim 1, wherein the access system comprises at least one of stairs, an elevator, or a ladder.

10. The method of claim 1, further comprising erecting a ground-level enclosure in the underutilized space so that the ground-level enclosure is coupled to the support assembly and at least partially positioned beneath the module.

11. The method of claim 1, further comprising releasably coupling a utility connection of the module with a site utility connection.

12. The method of claim 1, wherein the support assembly is modular, and wherein the support assembly is erected in a temporary and removable manner.

13. The method of claim 12, wherein the access system is modular, and wherein the access system is erected in a temporary and removable manner.

* * * * *